United States Patent [19]

Aschenbeck et al.

[11] Patent Number: 4,693,357

[45] Date of Patent: Sep. 15, 1987

[54] MULTIPLE CHUTE COIN MECHANISM

[75] Inventors: Weldon J. Aschenbeck, Shiner, Tex.; Frank W. Medley, III, Cookeville, Tenn.

[73] Assignee: Kaspar Wire Works, Inc., Shiner, Tex.

[21] Appl. No.: 825,340

[22] Filed: Feb. 3, 1986

Related U.S. Application Data

[63] Continuation-in-part of Ser. No. 661,078, Oct. 15, 1984, Pat. No. 4,579,215.

[51] Int. Cl.[4] ..... G07F 5/04

[52] U.S. Cl. ..... 194/202; 194/233; 194/346

[58] Field of Search ..... 194/202, 204, 233, 248, 194/346

[56] References Cited

U.S. PATENT DOCUMENTS

| | | | |
|---|---|---|---|
| 575,715 | 1/1897 | Hertzberg . | |
| 2,638,198 | 5/1953 | Wellstein | 194/231 |
| 2,726,749 | 12/1955 | Du Grenier et al. | 194/290 |
| 3,298,492 | 1/1967 | Duncan | 194/204 |
| 3,464,530 | 9/1969 | Knickerbocker | 194/233 |
| 3,844,298 | 10/1974 | Schweitzer | 194/344 |
| 4,030,586 | 6/1977 | Etes | 194/237 |
| 4,273,255 | 6/1981 | Overall | 221/213 |

FOREIGN PATENT DOCUMENTS

| | | |
|---|---|---|
| 2937363 | 4/1981 | Fed. Rep. of Germany . |
| 1548504 | 1/1977 | United Kingdom . |

*Primary Examiner*—F. J. Bartuska
*Attorney, Agent, or Firm*—Luedeka & Neely

[57] ABSTRACT

The specification discloses a coin mechanism for dispensing machines including two or more rectangular chutes for receiving and containing a given number of coins. A rectangular gate selectively directs coins into the chutes and a rocker arm is operable to move the gate from a first position directing coins into the first chute to a second position directing coins into the second chute when the coins reach a predetermined height in a first chute. A pawl is adjustably mounted adjacent to the second chute to prevent upward movement of a predetermined number of coins deposited in the second chute. A catch plate pivotally attached to the door of the dispensing machine below the chutes supports the coins therein. The catch plate receives a hook which prevents opening of the door until the coins in the second chute are high enough to engage the pawl. A number of intermediate chutes may be located between the first and second chutes. A contact lever located in an intermediate chute is operable to engage the rocker arm and pivot the gate to a next position directing coins into the next chute when the coins in the intermediate chute reach a predetermined height. A gate retainer is operable to hold the gate in the first position. The gate retainer can be disengaged by movement of the rocker arm to allow the gate to move to its second position, or can be disengaged manually from the outside of the mechanism. A bumper prevents disengagement of the gate retainer if the mechanism is tilted.

21 Claims, 20 Drawing Figures

MULTIPLE CHUTE COIN MECHANISM

This is a continuation-in-part of Application Ser. No. 06/661,078 filed on Oct. 15, 1984, now U.S. Pat. No. 4,579,215.

The present invention relates to coin mechanisms and more particularly relates to a coin mechanism which controls the operation of dispensing machines.

Coin mechanisms have long been used in dispensing machines to facilitate operation of the machines in response to a given number or combination of coins deposited therein. For example, in newspaper machines coin mechanisms have been used to allow customers to open the door and retrieve a paper after depositing the required number and type of coins. These coin mechanisms have generally consisted of a single chute for receiving and containing the required number of coins and a sensing mechanism operable to allow retrieval by a customer of a paper after the required number of coins have been deposited in the chute. The use of a single chute requires that the chute be lengthened or shortened or that sensors in the chute be modified as prices or combinations of coins change. If, for example, the price of a Sunday paper changes from $1.50 to $2.00, the entire mechanism may have to be altered or replaced due to the lengthening of the chute to receive the additional coins. Moreover, from a design standpoint, lengthening of the chute may make it too long in relation to the other components of the mechanism. This excessive length may impede the ability to economize space and materials since the other components can generally be contained within the mechanism in the vertical space of just a few coins. Also, the tendency of coins to jam or shingle increases as the chute length increases. As a consequence, a need exists for a practical and workable coin mechanism allowing operation of dispensing machines without altering the length of the chutes after a change in the number of coins required. Such a mechanism would be easier to design and could be produced more efficiently by allowing manufacture of standard size parts. Additionally, such a coin mechanism would have smaller overall length dimensions and require a smaller space in the dispensing machine.

The present invention solves the foregoing and other problems long associated with coin mechanisms used in dispensing machines by providing a coin mechanism having multiple chutes which eliminates the need to increase the chute length when coin requirements change and reduces the overall length of the mechanism.

In accordance with the present invention, a coin mechanism for use in a dispensing machine to receive and detect the presence of a predetermined number of coins is provided. At least first and second generally vertical coin chutes receive coins of a predetermined dimension, the chutes having a width and thickness of about, but greater than, the width and thickness of the coins. A gate is mounted in the mechanism above the chutes and is movable between at least a first and a second gate position for directing coins into one of the chutes. The gate is operable in its first position to direct coins into the first chute and operable in its second position to direct coins into the second chute. A mechanical linkage, preferably a rocker arm, is mounted adjacent to the first chute for movement between a first and a second position. A contact arm is formed on the mechanical linkage for engaging and moving the gate from the first gate position to the second gate position when the mechanical linkage moves from the first linkage position to the second linkage position. A finger is formed on the mechanical linkage for engaging coins in the first chute and is operable to move the mechanical linkage from the first linkage position to the second linkage position when the finger is engaged by a coin within the first chute so that coins falling by gravity in the first chute will engage the finger causing the finger to move the mechanical linkage to the second linkage position, and cause the contact arm to move the gate from the first to the second gate position. A stop is provided for stopping the coins from moving down the first chute and is positioned a predetermined distance from the finger. A predetermined number of coins of a predetermined dimension will stack up in the first chute and the top coin in the stack will be positioned adjacent to and in contact with the finger thereby holding the mechanical linkage and the gate in their respective second positions directing coins into the second chute. In this construction, a multiple of standard size chutes may be used thereby eliminating the need to increase the length of a chute when coin requirements change and reducing the overall length of the mechanism. For example, one embodiment of the present invention used in newspaper dispensers would have two chutes for receiving quarters. During the week the mechanism is adjusted so that quarters will only enter the one quarter chute and one quarter will actuate the dispenser. On Sunday the mechanism is adjusted so that both chutes are operable and it is necessary to fill both chutes with quarters in order to operate the mechanism.

As indicated above, in the use of multiple chutes means should be provided to direct the coins to another chute when one becomes full and the present invention provides for a gate and mechanical linkage assembly operable to direct coins into one chute upon the filling of another. In the prior art, means are known to prevent overfilling of coin storage devices. For example, as shown in German Pat. No. 2,937,363 a wiper may be used as a bypass to prevent blockage of a coin storage device. The wiper is pivoted when the coin storage is full to direct coins through an ejector opening. The lower portion of the wiper engages falling coins and pivots the upper portion of the wiper into the chute to eject coins.

The German patent does not suggest that its wiper could be used in coin mechanisms having multiple coin chutes and it would be ill-suited for such use. The German design requires that the coin storage be invaded at the point the coins are ejected, requires an indent in the coin storage to receive the wiper and requires an ejector opening in the coin storage near the wiper.

The presence of an ejector opening in the chute invites failure in the form of accidental coin ejection, and the presence of the entire wiper in the coin storage creates a risk of coin jamming. For example, if two coins were falling down the chute together, the first coin would engage the lower end of the wiper and cause it to pivot, and the upper section of the wiper could possibly pin the second coin on the wall of the chute, and both coins would be caught.

Problems such as the above are prevented in the present invention by using a single gate with a multiple of coin chutes. Since the coins are directed into the chutes independently of the chutes themselves by the gate, the risk of jamming in the chutes is minimized.

In accordance with another aspect of the present invention, at least first, second and third generally vertical coin chutes for receiving coins of a predetermined dimension having a width and thickness of about, but greater than, the width and thickness of the coins are used in a coin mechanism for dispensing machines. A gate is mounted in the mechanism above the chutes and is movable between at least a first, second and third gate position for selectively directing coins into one of the chutes. The gate is operable in its first position to direct coins into the first chute, operable in its second position to direct coins into the second chute, and operable in its third position to direct coins into the third chute. A rocker arm is mounted adjacent to the first chute for rocking between at least a first, second and third rocker arm position having a contact arm formed thereon to engage and move the gate to the first, second and third gate positions when the rocker arm moves to its first, second and third positions. A finger is formed on the rocker arm for engaging coins in the first chute and is operable to move the rocker arm. When engaged by a coin falling by gravity in the first chute, the finger causes the rocker arm to move to the second rocker arm position which causes the contact arm to move the gate from the first to the second gate position. A coin stop is positioned a predetermined distance from the finger means so that a predetermined number of coins will stack up in the first chute and the top coin in the stack will be positioned against the finger thereby holding the rocker arm and the gate in their respective second positions and directing coins into the second chute.

A second finger is mounted adjacent to the second chute to engage coins in the second chute and is movable between a first and a second position. This second finger is disposed in the second chute so that coins falling in the second chute will engage and move it from the first to the second position. A mechanical linkage is connected between the second finger and the rocker arm and moves the rocker arm to the third rocker arm position in response to movement of the second finger means to its second position, thereby moving the gate to its third position. The stop is operable to stop the coins from moving down the second chute and is positioned a predetermined distance from the second finger. Thus, a predetermined number of coins will stack up in the second chute and the top coin in the stack will be positioned against the second finger thereby holding the rocker arm and gate in their respective third positions to direct coins into the third chute.

In accordance with yet another aspect of the present invention, a disengagable gate retainer is disclosed for holding the gate in the first position. The gate retainer is responsive to the rocker arm to disengage and allow the rocker arm to move the gate at least from the first gate position to the second gate position.

In accordance with still another aspect of the present invention, the disengagable gate retainer is pivotally connected to the gate and configured to be pivoted an incremental amount by the rocker arm. A stop engages the gate retainer to prevent movement of the gate to the second position, the gate retainer being biased to pivot in the direction of the stop. In this embodiment, the gate retainer is configured so that when the rocker arm engages the gate retainer, the retainer is pivoted by the incremental amount and clears the stop. This facilitates further pivoting of the gate retainer permitting the rocker arm to move into engagement with the gate to move the gate at least from the first gate position to the second gate position.

According to another aspect of the present invention, a bumper is provided for preventing the gate from moving from the first gate position to the second gate position when the mechanism is rotated in a plane generally parallel to the direction of movement of the gate from the first gate position to the second gate position.

In accordance with a further aspect of the present invention, a series of levers, linkages and springs are operable to induce movement of the gate independently of the presence or absence of coins within the first chute so that the gate retainer can be disengaged by the rocker arm and the gate moved at least from the first gate position to the second gate position. In this embodiment, the levers, linkages and springs can be configured and arranged to be selectively operable from outside the mechanism.

The advantages and further aspects of the present invention will be readily appreciated by those of ordinary skill in the art as the same becomes better understood by reference to the following detailed description when considered in conjunction with the accompanying drawings in which:

FIG. 1 is a perspective view of the coin mechanism showing two chutes, a gate, a rocker arm, a pawl assembly, and a catch plate along with other parts of one embodiment of the present invention, some parts being broken away and shown in section to illustrate details of the construction;

FIG. 2*a* is a fragmentary front elevational view of the coin mechanism illustrating the positions of the gate coin slot and the gate relative to the chutes and the outer coin slot;

FIG. 2*b* is a fragmentary front elevational view of the coin mechanism showing a chute between the coin slot of the dispensing machine and the top opening of the gate;

Figure 13:
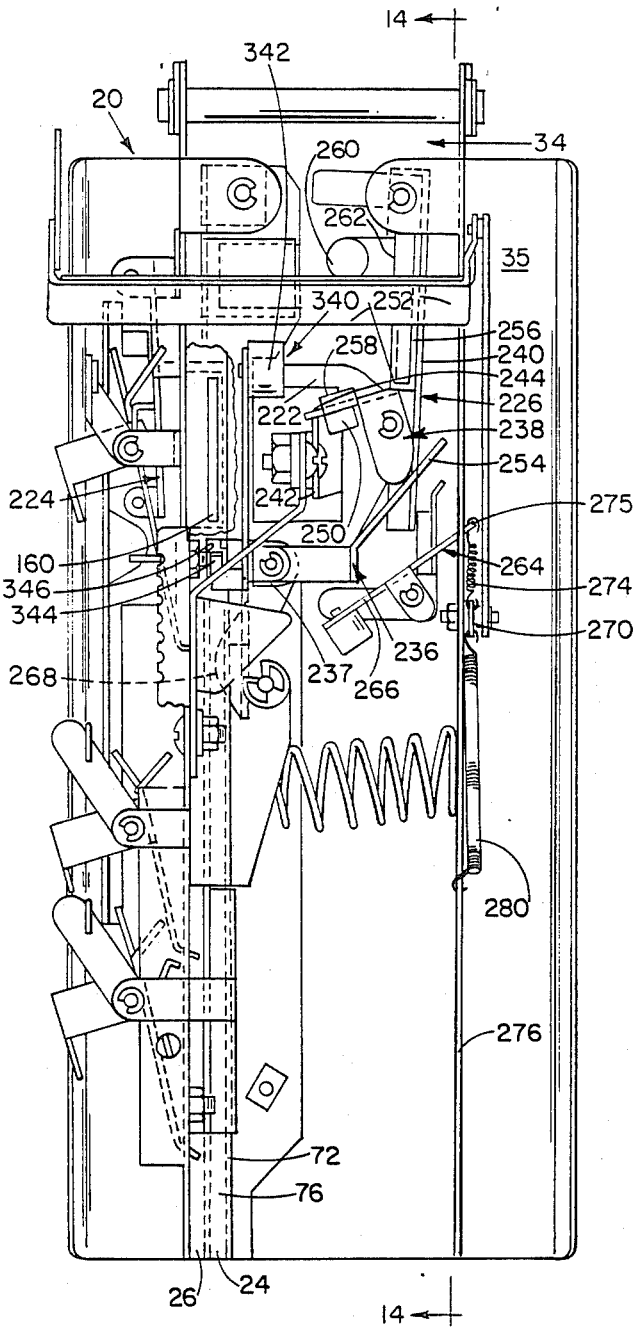
FIG. 13 is a rear elevational view of another embodiment of the coin mechanism illustrating the use of a disengagable gate retainer for preventing movement of the gate away from a position at the gate coin slot aligned with the first gate chute.
Figure 14:
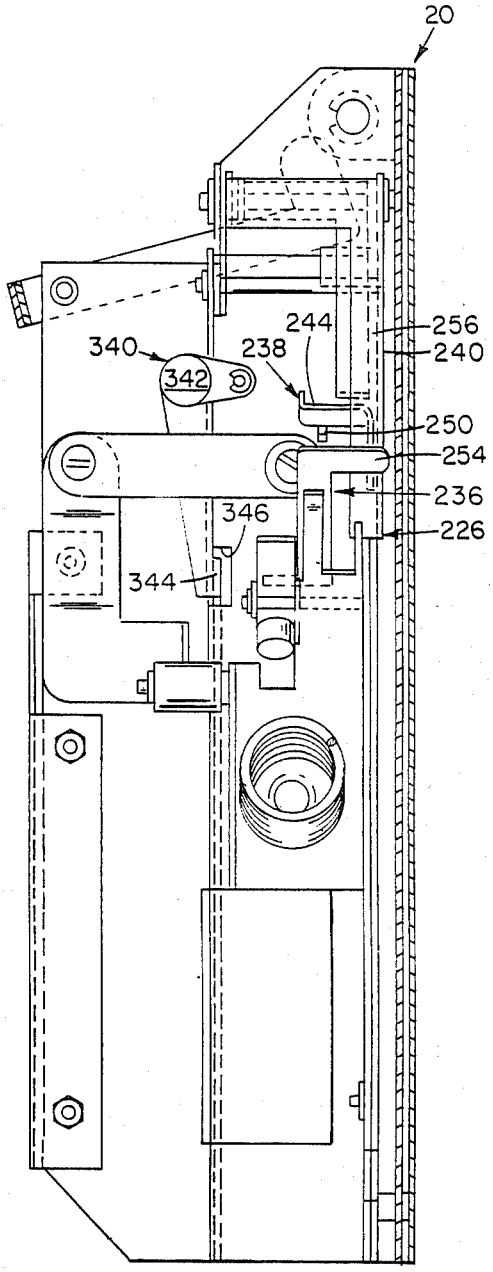
FIG. 14 is a side view of the coin mechanism shown in FIG. 13.
Figure 15A:
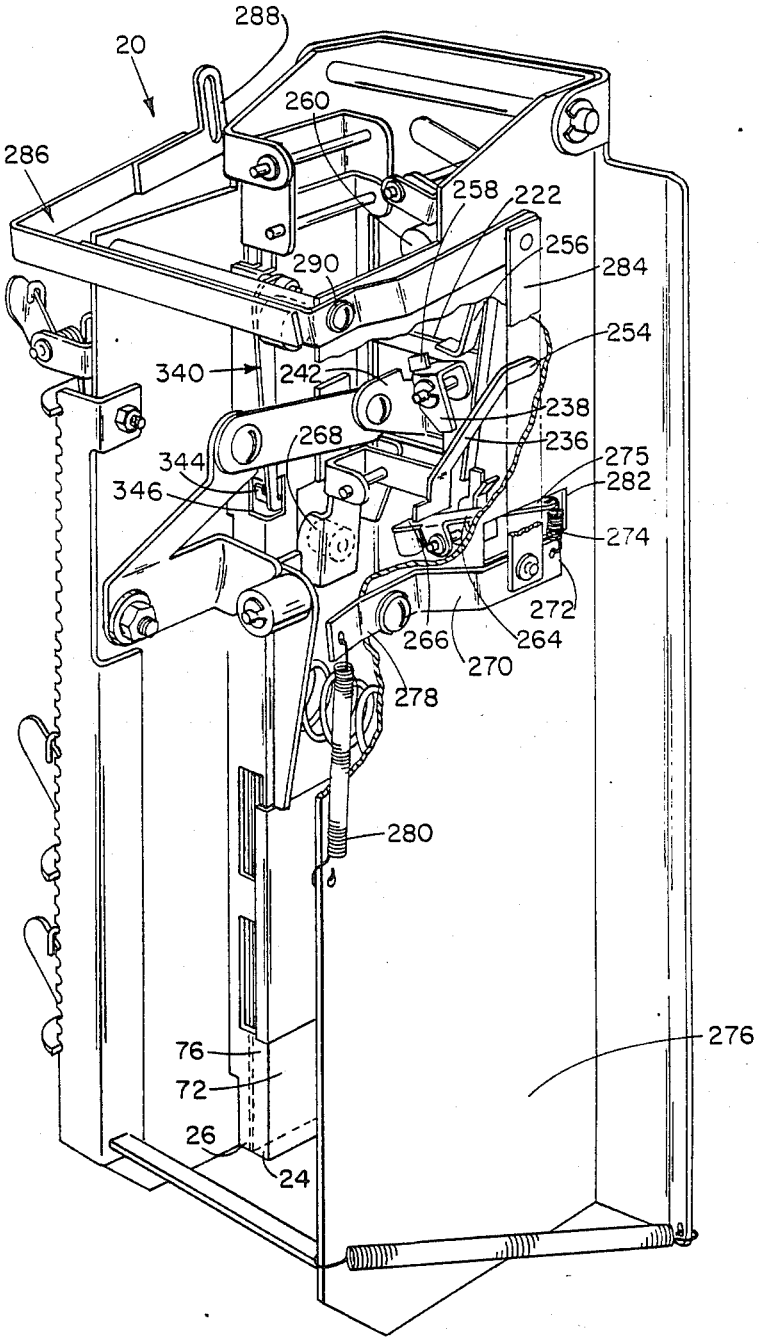
Figure 15B:
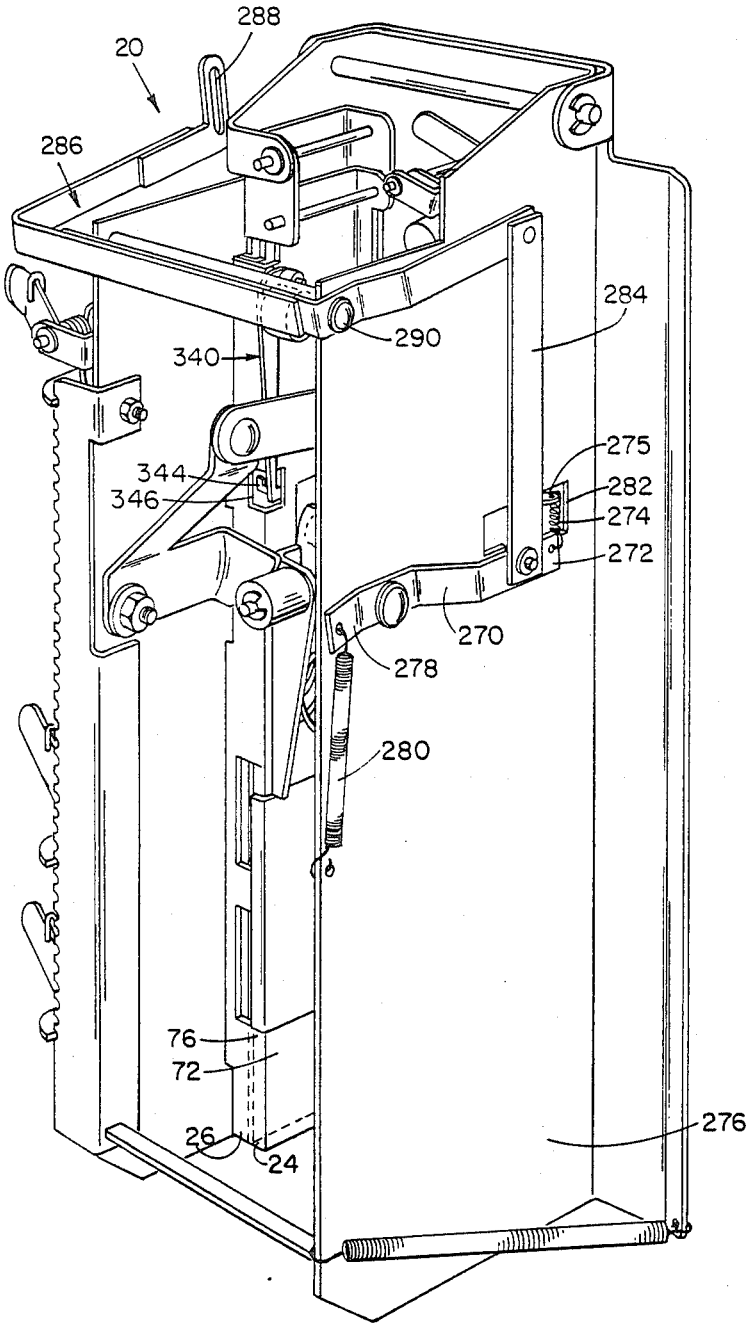
Figure 18:
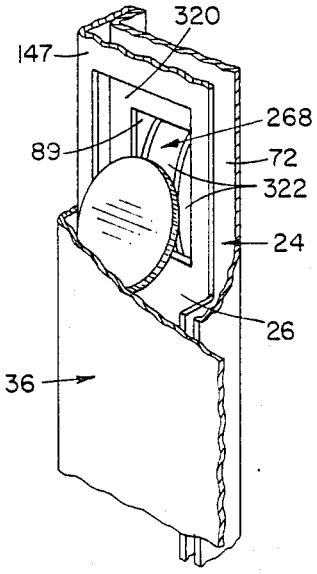
Figure 16:
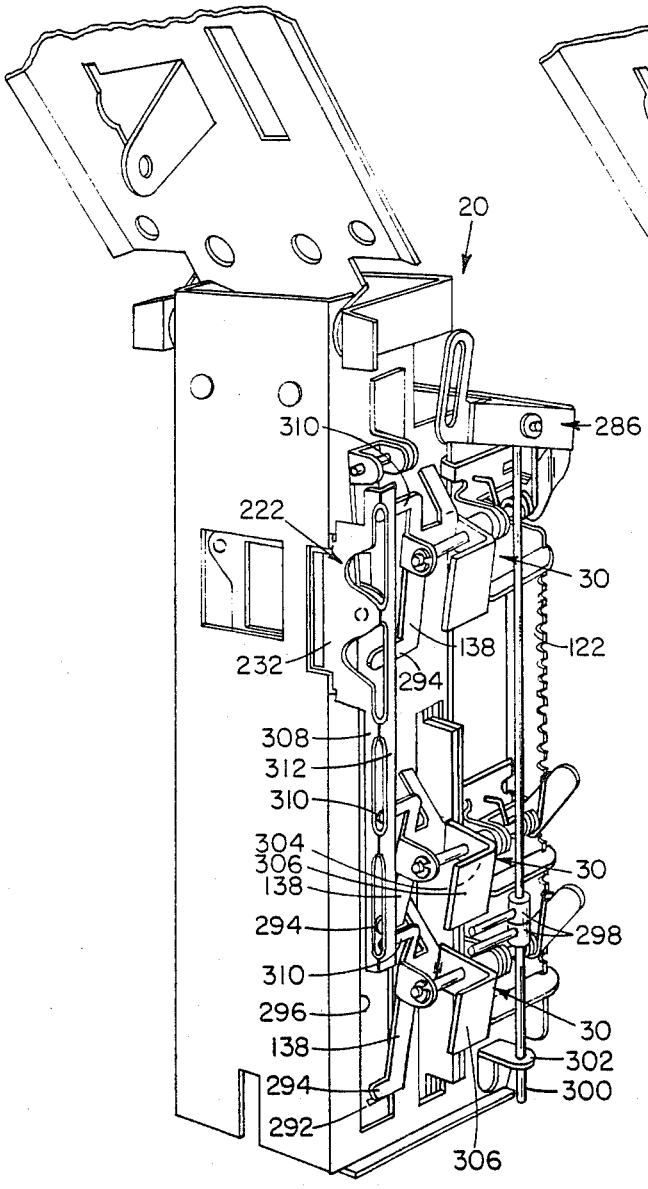
Figure 17:
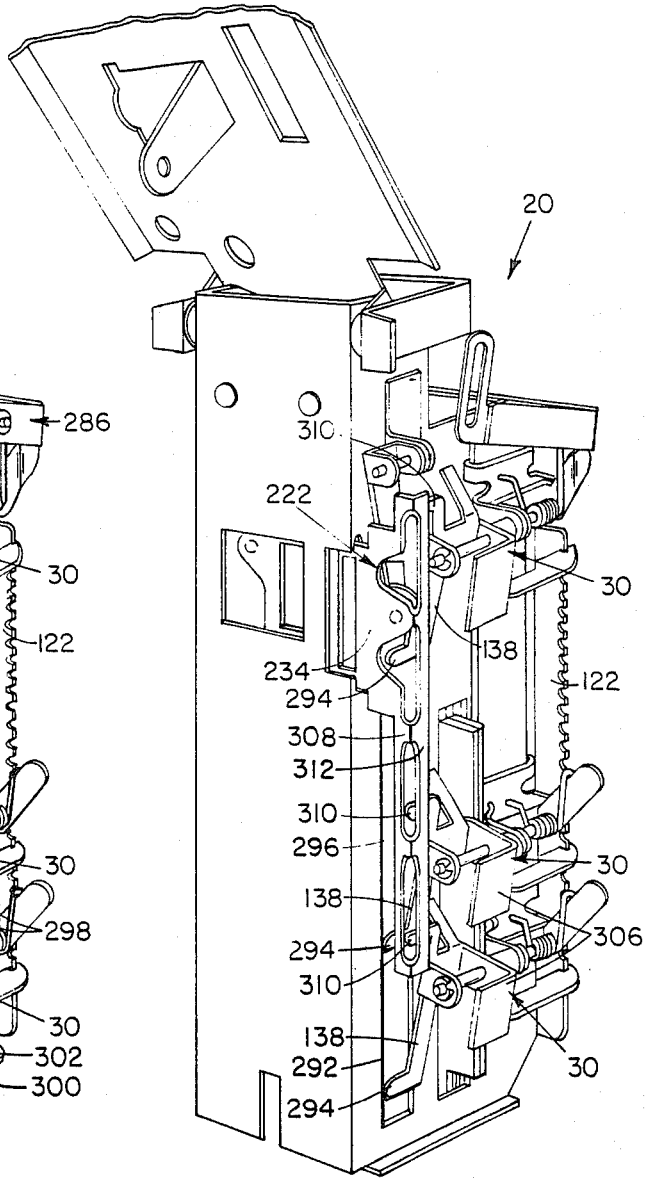

FIG. 15*a* is a perspective view of the coin mechanism shown in FIG. 13 with a side wall partially broken away to show details of the gate retainer and other structure;

FIG. 15*b* is a perspective view of the coin mechanism shown in FIG. 13;

FIG. 16 is a perspective view of the coin mechanism shown in FIG. 13 on the opposite side of the coin mechanism from the view shown in FIGS. 15*a* and 15*b* illustrating a positioning bar extending from the gate for holding the pawls out of the second chute and a dog bar with dogs attached for selectively holding certain pawls out of the second chute;

FIG. 17 is a perspective view of the coin mechanism shown in FIG. 16 with the dog bar and dogs removed; and FIG. 18 is a somewhat diagrammatical detailed view showing a nickel diversion slot in the wall between the first and second chutes.

Figure 1:
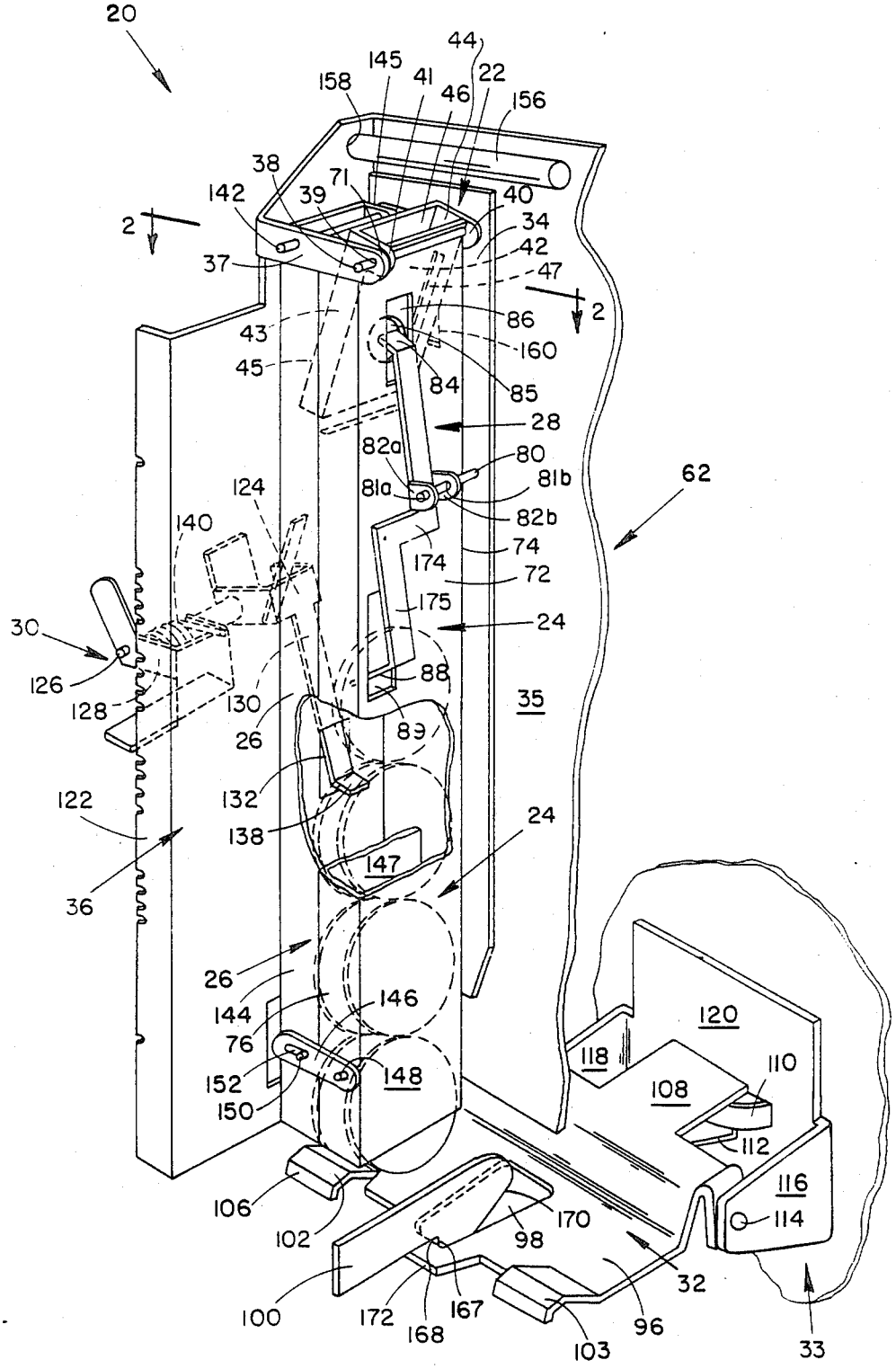

Referring now to the drawings in which like reference characters refer to like or similar parts throughout the several views, there is shown in FIG. 1 a coin mechanism 20 embodying one form of the present invention. The coin mechanism 20 includes a downwardly directed rectangular gate 22 pivotally mounted above first and second downwardly directed rectangular chutes 24 and 26. A generally vertical rocker arm 28 is located on the first chute 24 and is operable to pivot the gate 22. A pawl assembly 30 is located adjacent the second chute 26 and prevents upward movement of coins in the second chute 26 and a generally horizontal catch plate 32 is located below the chutes 24 and 26. The catch plate 32 is attached to the front door 33 (partially shown) of the dispensing machine and supports coins deposited in the chutes 24 and 26, and is operable to be moved from beneath the chutes 24 and 26 when they become filled with coins. All components are conventionally constructed of a suitable metal or plastic.

Basically, the gate 22 functions to direct coins into one of the two chutes 24 or 26, and the rocker arm 28 controls the position of the gate 22. Coins stack up the chutes 24 and 26 while resting on the catch plate 32, and when the first chute 24 is stacked full, the rocker arm 28 moves the gate 22 so that coins are then directed into the second chute 26. The gate 22 and its interaction with the rocker arm 28 and associated mechanisms, as hereinafter described in greater detail, are operable to provide a reliable mechanism for directing coins into a number of chutes with a minimized risk of failure or jamming.

A generally vertical support wall 34 is located between the chutes 24 and 26 and an inside surface 35 of the front of the mechanism 10. A generally vertical side plate 36 extends from the surface 35 and is generally perpendicular thereto. A horizontal support arm 37 extends from the top of the side plate 36. The arm 37 is generally perpendicular to the side plate 36 and extends along its length parallel to the support wall 34, and is spaced apart from the support wall 34 sufficient to receive the width of the chutes 24 and 26 therebetween.

A horizontal gate pin 38 is perpendicular to the support wall 34 and extends from near the top of the support wall 34 to the support arm 37 and through an aperture 39 located in the approximate center of the end of the support arm 37. The gate 22 is pivotally mounted on the pin 38 by means of a front tab 40 and a rear tab 41. The tabs 40 and 41 extend perpendicular to the uppermost part of a first rectangular side wall 42 of the gate 22. The gate 22 also includes a second rectangular side wall 43 spaced from the first side wall 42 a distance slightly greater than the thickness of the coins that the gate 22 is designed to receive. The sides 42 and 43 are generally parallel and are approximately the same size. First and second rectangular edge walls 44 and 45 extend between the side walls 42 and 43 forming a passageway 46 through which deposited coins travel to chutes 24 and 26. The edge walls 44 and 45 are generally parallel and are spaced apart a distance slightly greater than the width of the coins that the gate 22 is designed to receive. The tabs 40 and 41 which extend from the first side wall 42 are essentially coplanar with the edge walls 44 and 45, respectively.

A rectangular coin slot 47 is located in the approximate center of the first edge wall 44 for receiving into the gate 22 coins which have been deposited in the dispensing machine.

The first chute 24 is pivotally mounted on the gate pin 38 by means of front and rear tabs 70 and 71 (see FIG. 8) and in a preferred embodiment includes a width wall 72, a first edge wall 74 and a second edge wall 76. The first chute 24 is open at the top and bottom and dimensioned generally to receive coins of the width and thickness which will be deposited therein. The tabs 70 and 71 are attached to the top of the width wall 72 of the first chute 24 and are generally perpendicular to the plane of the width wall 72 and generally coplanar with the edge walls 74 and 76 of the first chute 24. The distance between the first and second edge walls 74 and 76 of the first chute 24, and therefore the distance between the tabs 70 and 71, is such that the gate 22, when pivotally mounted on the gate pin 38, is between the tabs 70 and 71 so that the gate 22 may rotate within and essentially independently of the first chute 24. The front tab 40 and the rear tab 41 of the gate 22 are adjacent to and may be in contact with the inward surfaces of the front and rear tabs 70 and 71, respectively, of the first chute 24.

The rocker arm 28 is pivotally mounted on a generally horizontal rocker arm pin 80 and serves as a mechanical linkage. The rocker arm pin 80 is attached to the support wall 34 and extends perpendicular to the wall 34. The rocker arm 28 is mounted on the pin 80 by insertion of the pin 80 into apertures 81*a* and 81*b* provided in the approximate center of two pivot tabs 82*a* and 82*b*, respectively. An upper finger 84 at the top of the rocker arm 28 rests on a gate cam 85 located on the outer surface of the side wall 42 of the gate 22. The upper finger 84 enters the first chute 24 through a first opening 86 in the upper part of the width wall 72 of the first chute 24. A lower finger 88 enters the first chute 24 through a second opening 89 in the lower part of the width wall 72. The lower finger 88 and upper finger 84 are preferably formed by bending a small portion of the upper and lower ends of the rocker arm 28 such that the bends form obtuse angles with the side of the rocker arm 28 closest to the first chute 24.

Figure 2A:
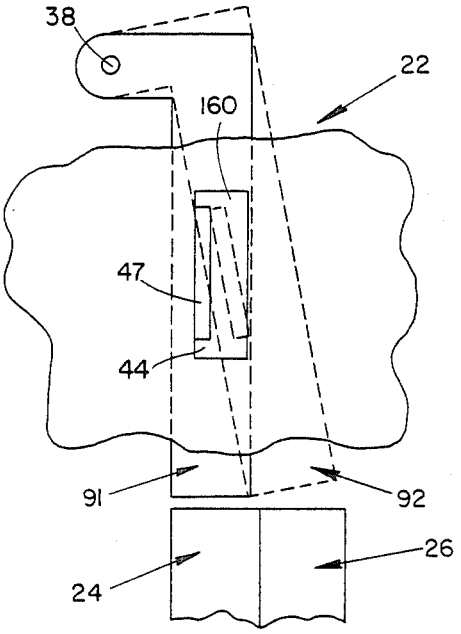
Figure 2B:
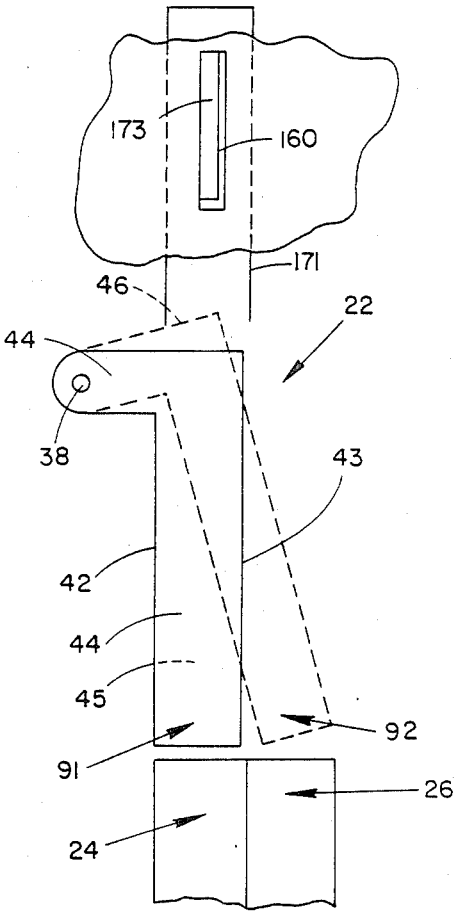
Figure 3:
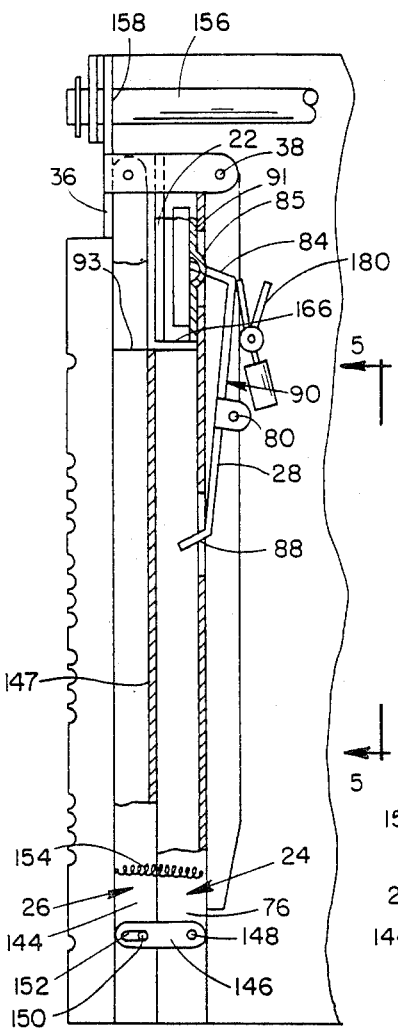
FIG. 3 is an elevational view of the coin mechanism illustrating the rocker arm position in the first chute as a coin passes through the gate, some parts being broken away and shown in section.
Figure 4:
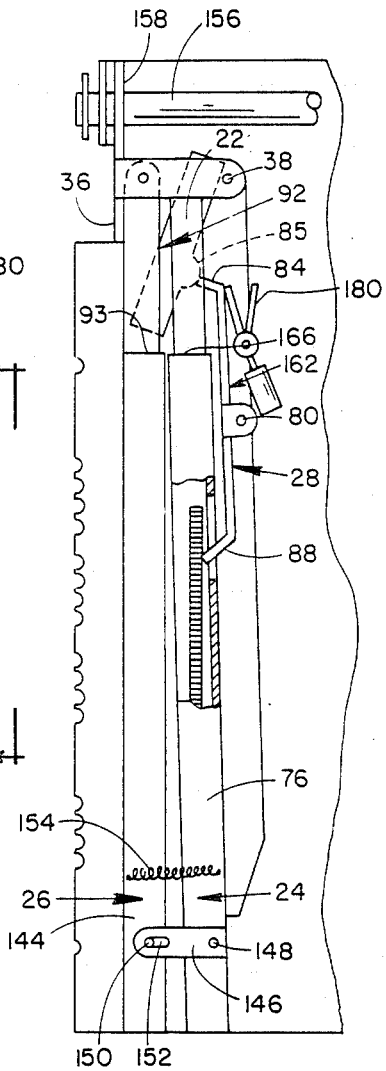
FIG. 4 is an elevational view of the coin mechanism illustrating the rocker arm and gate positions when a coin is adjacent to the rocker arm, some parts being broken away and shown in section.

Referring to FIG. 1 in conjunction with FIG. 2 through 4, the rocker arm 28 is configured to provide for rotation of the arm 28 about the pin 80 as coins fall through the first chute 24. The rotation of the arm 28 due to movement of coins past the lower finger 88 causes the upper part of the rocker arm 28 to move from a first position 90 toward the first chute 24. As the upper part of the rocker arm 28 moves toward the first chute 24, the movement of the upper finger 84 which is in contact with the gate cam 85 causes the gate 22 to rotate from a first position 91 to a second position 92 so that the lower opening of the gate 22 is above a top opening 93 of the second chute 26. After the coin passes the lower finger 88, the rocker arm 28 and the gate 22 return to their first positions 90 and 91, respectively, with the lower opening of the gate 22 above the first chute 24.

Referring again to FIG. 1, the catch plate 32 is oriented in a plane approximately perpendicular to the side plate 36 of the coin mechanism 20 below the chutes 24 and 26 and is configured with a generally flat recessed center section 96 which supports the coins deposited in the chutes 24 and 26. In the approximate center of the recessed section 96 of the catch plate 32 an opening 98 receives a hook 100. The hook 100 is configured to prevent the catch plate 32 from moving toward the front of the dispensing machine unless the catch plate 32 is rotated down and away from the chutes 24 and 26. The catch plate 32 includes a first cam 102 and a second cam 103. The cams 102 and 103 are preferably formed from an appendage located on each side of the catch plate 32 by bending each appendage upwardly to form a smooth path of travel for the coins up the cam 102 and down a lip 106 located at the rearward end of the cam 102.

A tongue 108 extends from the catch plate 32 in a direction toward the front of the dispensing machine and rests on a stop 110. The tongue 108 is maintained in a resting position on the stop 110 by a spring 112 mounted on a pin 114 which also pivotally supports the catch plate 32. The spring 112 is biased to urge rotation of the catch plate 32 in the direction of the chutes 24 and 26 and to provide support by the catch plate 32 of the coins deposited in the chutes 24 and 26. The pin 114 is mounted on support arms 116 and 118 which extend back toward the catch plate 32 from a stop support plate 120. The stop support plate 120 is attached to the door 33 (partially shown) of the dispensing machine.

The pawl assembly 30 is adjustably mounted on a notched rim 122 which extends outwardly from the side plate 36 in a direction away from the coin mechanism 20. A pawl 124 is pivotally mounted on a horizontally oriented pawl pin 126 which is attached to a pawl support 128. The pawl assembly 30 is generally mounted on the notched rim 122 so that a pawl arm 130 extends downwardly toward the second chute 26. The pawl arm 130 extends into the second chute 26 through a side plate opening 132 located at a predetermined height above the catch plate 32 to allow stacking of a given number of coins in the second chute 27 which is located adjacent to the side plate 36.

A finger 138 is provided at the lower end of the pawl arm 130. The finger 138 is preferably formed by bending a short section of the arm 130 upward so that the angle between the finger 138 and the upper surface of the arm 130 is obtuse. Preferably, the angle is sufficient to provide that the finger 138 points slightly downward in the second chute 26 so that coins which pass by the finger 138 deflect and pass by the finger 138 insted of becoming lodged on its upper surface. Also, the length of the finger 138 from the bend to its tip should be sufficient to allow the finger 138 to almost traverse the second chute 26 and prevent coins from moving up the second chute 26.

The pawl 124 is biased by a pawl spring 140 to rotate upward and into the second chute 26 after being deflected down by a coin falling through second chute 26. The upward rotation of the pawl 124 is preferably stopped by contact of the upper surface of the pawl arm 130 with the top of the side plate opening 132. The angle between the pawl arm 130 and the side plate 36 should be such that the finger 138 will nearly traverse the second chute 26 and prevent coins from moving up the second chute 26 when the catch plate 32 is moved toward the front of the dispensing machine.

The second chute 26 is pivotally mounted between the first chute 26 and the side plate 36 by a second chute pin 142 configured similar to the gate pin 38. The second chute 26 has, as its width wall adjacent the side plate 36, the inside of the side plate 36 of the coin mechanism 20 and has a first edge wall 144 and a second edge wall 145 extending perpendicular to the side plate 36. The second chute 26 is dimensioned similar to and is essentially coplanar with the edge walls 74 and 76 of the first chute 24. The second chute 26 has, as its width wall adjacent to the first chute 24, a width wall 147, providing for sharing of the width wall 147 between the first and second chutes 24 and 26. The width wall 147 does not extend to the top of the second chute 26 as do the edge walls 144 and 145. Instead, the width wall 147 extends up to and is terminated immediately below the path of rotation of the gate 22 as it pivots from its first position 91 to its second position 92. So configured, the width wall 147 will not interfere with movement of the gate 22.

Referring to FIG. 1 in conjunction with FIG. 3 and FIG. 4, a sliding hinge 146 is pivotally attached for vertical rotation by a pin 148 to the second edge wall 76 of the first chute 24 near the bottom, and is slidably attached by a pin 150 to the first edge wall 144 of the second chute 26. The sliding hinge 146 provides for restricted horizontal movement of the chutes 24 and 26 with respect to each other, the potential distance of separation of chutes 24 and 26 being limited by the length of a slot 152 in the sliding hinge 146. Horizontal movement of the chutes 24 and 26 is further restricted by a chute spring 154 attached to the first chute 24 on the second edge wall 76 slightly above the sliding hinge 146, and extending to the inside wall of the side plate 36 of the coin mechanism 20. The chute spring 154 is configured to somewhat restrict independent motion of the chutes 24 and 26 with respect to each other, and to somewhat restrict movement of the chutes 24 and 26 in tandem with respect to the other parts of the coin mechanism 20 while the coin mechanism 20 is shaken to alleviate shingling of coins, jamming, etc.

The coin mechanism 20 is pivotally mounted on the dispensing machine by a horizontal mechanism support pin 156 which is generally parallel to the front 35 of the mechanism 10. The pin 156 is passed through an aperture 158 in the top of the side plate 36 of the coin mechanism 20 and through another aperture located in a side cover plate (not shown) which is generally parallel to the side plate 36, the aperture in the side cover plate being horizontally aligned with the aperture 158. The pin 156 may be attached to the dispensing machine in any convenient manner such that the coin mechanism 20 will pivot upwardly and away from the front of the dispensing machine.

Referring now to FIG. 2*a*, in a preferred embodiment the coins to be deposited enter the dispensing machine through a rectangular outer coin slot 160 and enter the coin mechanism 20 through the coin slot 47 on the first edge wall 44 of the gate 22. Also depicted in FIG. 2*a* are the first position 91 of the gate 22 and the second position 92, the former being an orientation of the lower opening of the gate 22 above the first chute 24 and the later being an orientation of the lower opening of the gate above the second chute 26. As can be seen from FIG. 2*a*, the coin slot 47 is accessable for depositing coins through the outer coin slot 160 in both gate 22 positions 91 and 92.

Referring to FIG. 1 in conjunction with FIG. 2*a*, FIG. 3 and FIG. 4, when the coin mechanism 20 is empty the gate 22 is in its first position 91. The rocker arm 28 is free in its first position 90 at the bottom so that the lower finger 88 enters the first chute 24 and substantially traverses the first chute 24. The first coin deposited in the outer coin slot 160 and into the coin slot 47 falls through the gate 22 and into the first chute 24. As the coin engages the upper surface of the lower finger 88, the force causes the lower finger 88 to deflect in a direction toward the second opening 89 in the first chute 24 pivoting the rocker arm 28 about the pin 80. The rocker arm 28 pivots about the pin 80 to a second position 162. The resulting force applied by the upper finger 84 on the gate cam 85 causes the gate 22 to rotate about gate pin 38 to its second position 92. After the coin passes by the lower finger 88, the weight of the gate 22 against the upper finger 84 causes the rocker arm 28 to pivot back to its first position 90 where the lower opening of the gate 22 is above a top opening 167 of the first chute 24. The coin comes to rest in a upright position on the recessed center section 96 of the catch plate 32 which is below the lower opening of the first chute 24. The catch plate 32 is positioned below the first chute 24 such that the majority of the cin remains upright in the first chute 24. This process continues until the desired height of coins is reached in the first chute 24 causing, as can be seen in FIG. 1 and FIG. 4, the gate 22 to remain in the second position 92 due to the presence of the top coin in the first chute 24 which forces the rocker arm 28 to remain in its second position 162 supporting the gate 22 above the top opening 93 of the second chute 26.

When the first chute 24 is filled and the gate 22 is in the second position 92, a coin deposited in the coin slot 47 passes into the top opening 93 of the second chute 26. As the coin passes down through the second chute 26 it engages the finger 138 of the pawl 124 causing the latter to be deflected downward allowing the coin to pass to the bottom of the second chute 26 where it comes to rest on the recessed center section 96 of the catch plate 32.

As additional coins are deposited in the coin mechanism 20 the process above with regard to the pawl 124 repeats until the total predetermined number of coins have been deposited. The preset location of the pawl finger 138 in the second chute 26 is such that when the last coin is deposited into the second chute 26 and the pawl 124 returns from its deflection, the pawl finger 138 comes to rest immediately above the highest coin in the second chute 26.

After the chutes 24 and 26 are filled with the required number of coins, the dispensing machine may be opened and the desired item removed by movement of the door 33 to which the catch plate 32 is attached in a direction away from the chutes 24 and 26. The initial movement of the catch plate 32 causes the bottom of the coins to engage the first cam 102. Further movement of the catch plate 32 causes the cam 102 to press the coins with an upward force which is resisted by engagement of the top coin in the second chute 26 with the pawl finger 138. As a result, the coins in the second chute 26 do not rise in the chute but apply a downwardly directed force to the cam 102 causing a downward rotation of the catch plate 32 in opposition to the bias provided by the spring 112. The downward rotation of the catch plate 32 prevents the hook 100 from engaging the catch plate 32 at the opening 98, a downwardly directed barb 167 of the hook 100 being spaced from a rear lip 168 of the opening 98 a sufficient distance to allow for the initial horizontal movement of the catch plate 132 prior to its downward deflection. The barb 167 is vertically dimensionsed such that the downward deflection of the catch plate 32 caused by engagement of the coins on the first cam 102 is sufficient to allow the lip 168 of the opening 98 to pass under the tip of the barb 167. This configuration allows full horizontal displacement of the catch plate from beneath the coin chutes 24 and 26 so that the coins will fall into a suitable coin reservoir and the door 33 of the dispensing machine 62 may be opened to allow retrieval of the desired item.

Thereupon, the closing of the door 33 causes the catch plate 32 to return to its position under the chutes 24 and 26, the cam 102 being vertically dimensionsed such that its highest point does not engage the lowermost point on the first edge wall 74 of the first chute 24 or a corresponding point on the second chute 26, thus preventing the cam 102 from inteferring with closing of the door 33. The front of the hook 100 is likewise dimensioned and positioned so as not to interfere with the return of catch plate 32 to its position under the chutes 24 and 26 except by means of a slight downward deflection of the catch plate 32 caused by engagement of a front rearward sloping edge 170 of the barb 167 with a rearmost edge 172 of the catch plate 32. Alternatively, the barb 167 of the hook 100 may be configured with a front edge 170 sloping rearward providing sufficient downward deflecton of the catch plate 32 so that the cam 102 does not engage the first edge wall 74 of the first chute 24 when the catch plate 32 is being returned to its position under the chutes 24 and 26.

The hook 100 prevents the catch plate 32 from being moved horizontally from beneath the chutes 24 and 26 when an insufficient number of coins have been deposited in the chutes 24 and 26. As can be seen from FIG. 1, the absence of the top coin in the second chute 26 would remove the downward force on the cam 102 caused by engagement of the pawl finger 138 with the top coin. With nothing to restrain the upward movement of the coins in the second chute 26, the catch plate 32 is not sufficiently deflected in a downward direction to escape the barb 167 of the hook 100 thereby causing the barb 167 to engage the rear edge 168 of the opening 98 and prevent horizontal movement of the catch plate 32 from beneath the chutes 24 and 26.

Referring to FIG. 2*b*, an alternate placement of the coin mechanism 20 relative to the outer coin slot 160 is shown with the top opening of the gate 22 below the bottom opening of a rectangular top chute 171. The top chute 171 is provided with a rectangular opening 173 on one of its sides slightly larger than the outer coin slot 160 for receiving coins therethrough. The top chute 171 is attached adjacent to the inner side 35 of the front wall of the dispensing machine where the outer coin slot 160 is located so that the opening 173 covers the outer coin slot 160. The top chute 171 is dimensioned to be slightly larger than the coins to be deposited therein. In the alternative configuration of FIG. 2*b*, the top opening of the gate 22 is dimensioned larger than the bottom opening, the first edge wall 44 and the second edge wall 45 being wider at the top than at the bottom. The first side wall 42 and the second side wall 43 have the same width at the top and the bottom providing a generally decreasing cross-sectional area of the passageway 46. The top opening of the gate 22 is dimensioned in width such that a coin falling through the top chute 171 cannot engage the periphery of the top opening of the gate 22 either in its first position 91 or in its second position 92 as a coin passes through the top chute 171 into the gate passageway 46. The length of the top chute 171 may vary depending on design requirements of the dispensing machine.

Figure 5:
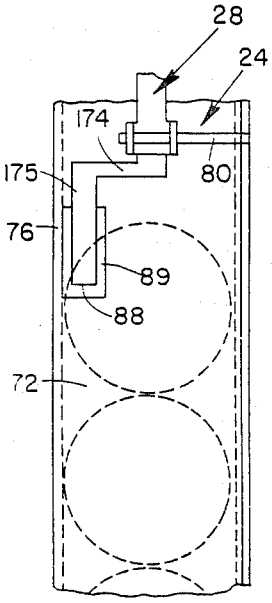
FIG. 5 is a side elevational view of the coin mechanism taken on the view lines 5—5 of FIG. 3 showing the lower part of the rocker arm.
Figure 8:
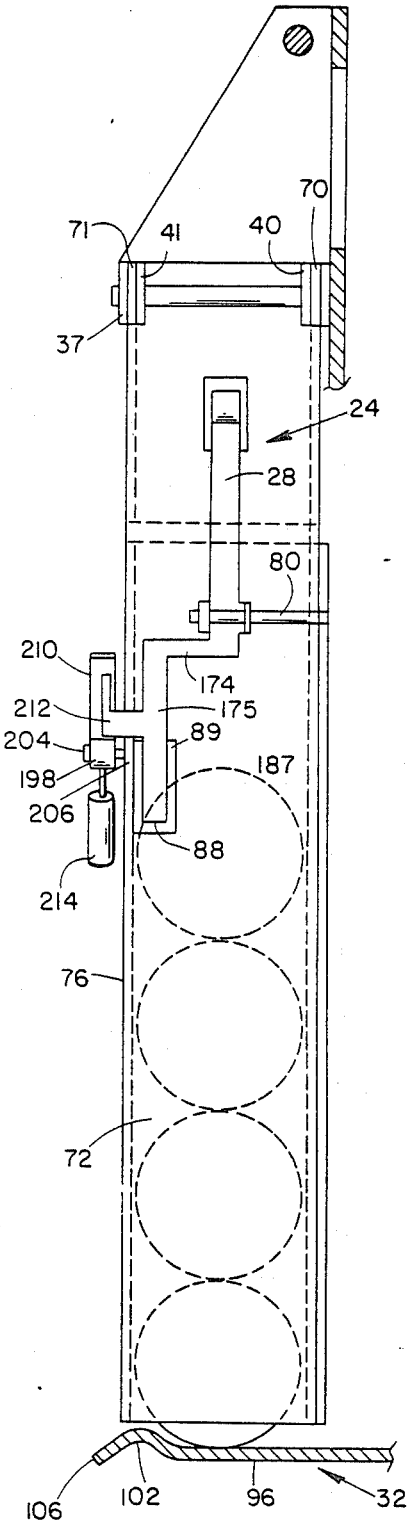
FIG. 8 is a side elevational view of a modified form of the coin mechanism illustrating the rocker arm shown in FIG. 5 in combination with a contact lever attached to the second of the three chutes shown in FIGS: 6 and 7.

Referring now to FIG. 1 in conjunction with FIG. 5 and FIG. 8, in the illustrated embodiments the rocker arm 28 protects against removal of the catch plate 32 from beneath the chutes 24 and 26 when coins smaller than those required, e.g., pennies or dimes, are deposited in the coin mechanism 20. The finger 88 is horizontally offset from the rocker arm 28 by means of an offset member 174, the overall vertical length of the rocker arm 28 from the gate cam 85 to the tip of the finger 88 being the same as described above. The horizontal offset of the finger 88 places the finger 88 adjacent to the inside surface of the second edge wall 76 of the first chute 24, the second opening 89 being located on the side of the width wall 72 to allow intrusion of the finger 88 into the first chute 24 to perform the function described above. The offset member 174 preferably extends horizontally from a location immediately below the attachment of the rocker arm 28 to the rocker arm pin 80 to a location near the second edge wall 76. A lower part 175 of the rocker arm 28 then extends from the end of the offset member 174 downward to the lower opening 89 where the finger 88 enters the first chute 24.

Referring to FIG. 3 and FIG. 4, a lock-out device 180 is shown providing the capability of manually positioning the gate 22 in its second position 92 over the top opening 93 of the second chute 26 when a smaller number of coins are required to operate the dispensing machine; e.g., in a newspaper dispensing machine both chutes 24 and 26 might be used for Sunday papers but only the second chute 26 would be required for papers during the remainder of the week. The lock-out device 180 is operable to engage the back surface of the rocker arm 28 above the pivotal attachment of the rocker arm 28 to the support wall 34 and move the gate 22 to its second position 92. Also shown in FIG. 4 is the maximum separation of the chutes 24 and 26 is determined by the length of the slot 152 in the sliding hinge 146 and the movement of both chutes 24 and 26 away from the side plate 36 as limited by the action of the chute spring 154.

Figure 6:
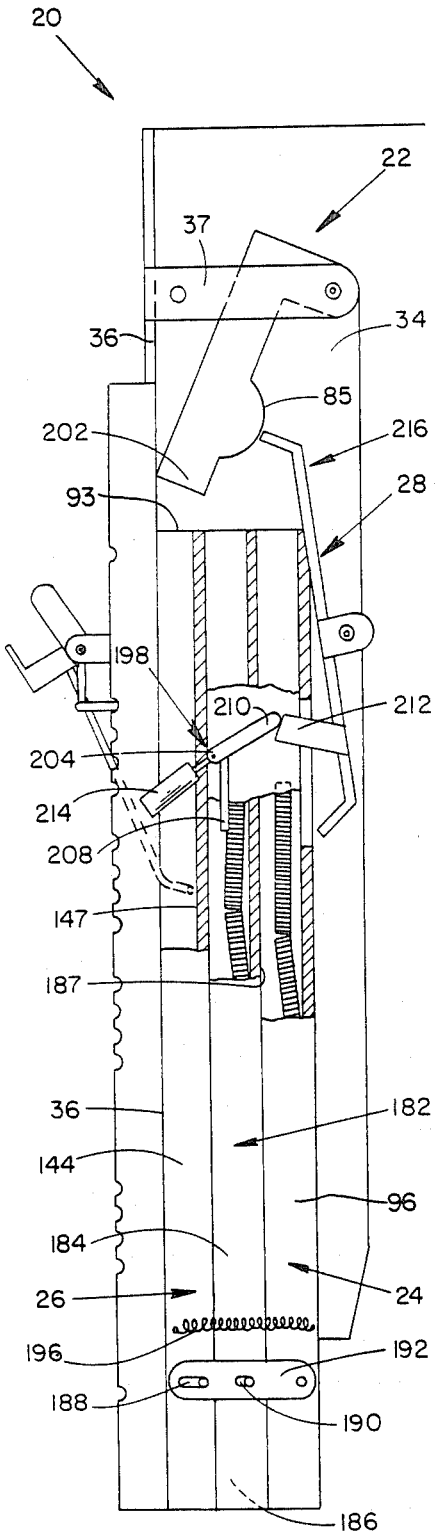
FIG. 6 is an elevational view of an alternate embodiment of the coin mechanism showing three chutes and illustrating the positions of the gate, the pawl and the rocker arm when the first and second chutes are filled with coins, some parts being broken away and shown in section.
Figure 7:
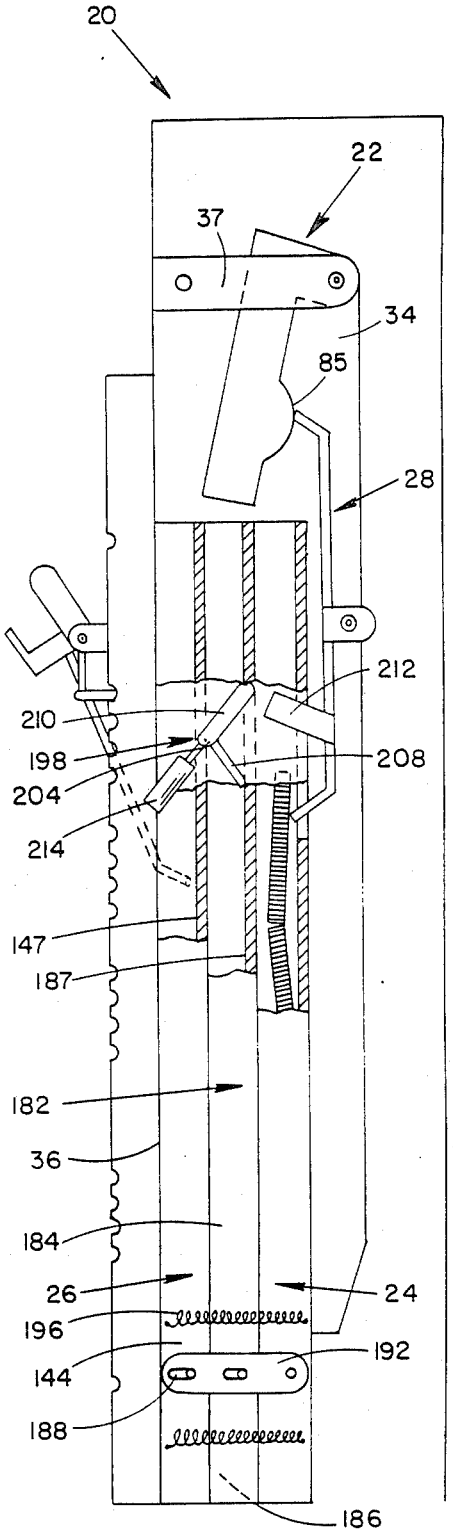
FIG. 7 is an elevational view of an alternate embodiment of the coin mechanism showing three chutes and illustrating the positions of the gate, the pawl and the rocker arm when only the first chute is filled with coins, some parts being broken away and shown in section.

Referring now to FIG. 6 and FIG. 7 where there is shown an alternate embodiment of the present invention, an intermediate rectangular chute 182 is added to the coin mechanism 20 providing additional coin capacity. The intermediate chute 182 is pivotally mounted on the support arm 37 and the support wall 34 between the first chute 24 and the second chute 26 in essentially the same manner as described above with respect to the second chute 26, the support arm 37 and the support wall 34 being dimensioned horizontally to receive the additional chute. The intermediate chute 182 is configured with a first edge wall 184, a second edge wall 186, and a width wall 187 on the side of the intermediate chute 182 adjacent to the first chute 24, the intermediate chute 182 having as its wall adjacent to the second chute 28 the width wall 147 of the second chute 26 providing for sharing between the second and intermediate chutes 26 and 182 of a common wall. It should also be noted that the width wall 187 is shared between the first chute 24 and the intermediate chute 182.

The sliding hinge 146 shown in FIG. 1 is modified to contain two slots 188 and 190 for limiting the separation of the chutes from one another when the coin mechanism 20 is shaken to remedy jamming or shingling of the coins. The modified sliding hinge 192 shown in FIG. 6 and FIG. 7 is pivotally attached to the lower part of the second edge wall 76 of the first chute 24. It is slidably attached to the first edge wall 184 of the intermediate chute 182 at slot 190 and to the first edge wall 144 of the second chute 26 at slot 188 and is essentially horizontal having a length approximately equal to the combined horizontal length of the three chutes 26, 182, and 24. As can be seen in FIG. 6, the slot 190 is somewhat shorter than the slot 188 due to the larger horizontal displacement of the second chute 26 with respect to the first chute 24 than would be the displacement of the intermediate chute 182 with respect to the first chute 24 when all three chutes 26, 182 and 24 are rotated away from the side plate 36. The chute spring 154 shown in FIG. 1 is modified in length and in strength to accommodate three coin chutes. The modified chute spring 196 is attached at one end to the first chute 24 above the sliding hinge 192 and extends generally horizontally to the inner surface of the side plate 36 where the other end of the spring 196 is attached.

A contact lever 198 is shown in FIG. 6. The lever 198 is located in the intermediate chute 182 at a vertical position so that by action of the contact lever 198 the desired height of coins to be deposited in the intermediate chute 182 will cause the gate 22 to move to a third position 202 with its bottom opening over the top opening 93 of the second chute 26. The contact lever 198 and its function can be better understood by reference to FIG. 7 and FIG. 8 in conjunction with FIG. 6. Referring to FIG. 7, the contact lever 198 is pivotally attached adjacent to the first edge wall 184 of the intermediate chute 182 and has a shaft 204 extending through an aperture 206 located in the first edge wall 184 at the desired vertical position and adjacent to the width wall 147 of the second chute 26. The shaft 204 extends into the intermediate chute 182 a sufficient distance to provide for attachment of a contact finger 208 which extends radially outward from the shaft 204. The contact finger 208 is relatively narrow in proportion to the width wall 147 of the second chute 26 and, as shown in FIG. 6, is of sufficient thinness to allow passage of coins down the intermediate chute 182 when the finger 208 is in a vertical position. The finger 208 is located near the inner surface of the first edge wall 184 of the intermediate chute 182 so that it will not be engaged by pennies, etc., and, as shown in FIG. 7, is of sufficient length to extend downward and across the intermediate chute 182 so that the tip of the finger 208 rests on the width wall 187 of the intermediate chute 182 in the manner shown in FIG. 7.

A contact arm 210 is attached to the part of the shaft 204 which extends out of the first edge wall 184. The contact arm 210 extends radially outward from the shaft 204 and is oriented on the shaft 204 so that when the contact finger 208 is engaged by a coin passing down the intermediate chute 182 the deflection of the contact finger 208 to an essentially vertical downward position against the width wall 147 of the second chute 26 causes the contact arm 210 to rotate and engage a contact member 212 located on the rocker arm 28. The contact member 212 consists of an angular extension from the rocker arm 28 and is located on the rocker arm 28 at a position so that it will be engaged by the contact arm 210. In one embodiment, the contact member 212 extends horizontally from the rocker arm 28 to a point slightly beyond the second edge wall 76 of the first chute 24 where it makes an approximately ninety degree bend in the direction of the contact arm 210. The part of the contact member 212 extending toward the contact arm 210 and the contact arm 210 are oriented and configured so that when the contact finger 208 is fully deflected and the contact arm 210 has fully engaged the contact member 212, the arm 210 and the member 212 do not meet "head on" thereby inhibiting return of the arm 210 and the member 212 to their prior positions. In their fully engaged positions, both the arm 210 and the member 212 should gently slope upward to the point of contact. In an alternate embodiment, as shown in FIG. 8, the contact member 212 extends from the offset member 174 described above with respect to FIG. 5 and FIG. 8.

A counterweight 214 is attached to the shaft 204 near the contact arm 210 and extends radially outward from the shaft 204. The counterweight 214 is positioned on the shaft 204 to ensure return of the contact finger 208 adjacent to the surface of the width wall 187 of the intermediate chute 182 after a coin has deflected and passed by the contact finger 208.

As discussed above, when the first chute 24 is filled with coins, the rocker arm 28 holds the gate 22 in a position directing coins into the next adjacent chute. Addition of the intermediate chute 182 to the coin mechanism 20 between the first and second chutes 24 and 26 results in coins being directed into the intermediate chute 182 when the gate 22 is held in position by coins within the first chute 24.

It can be seen from FIG. 6 that when the coins in the intermediate chute 182 are stacked to the desired height, the contact arm 208 in the intermediate chute 182 will be held in a downward vertical position holding the rocker arm 28 in a third position 216 which supports the gate 22 in its third position 202, thereby directing the remainder of deposited coins into the second chute 26. When the second chute 26 is filled, the dispensing machine may be operated as described above where the catch plate 32 is moved from beneath the coin chutes when the door 33 is opened allowing the coins deposited in the coin mechanism 20 to fall into a suitable coin reservoir, after which the door 33 is closed and the catch plate 32 returned to its position under the coin chutes 24 and 26 and the process is ready to begin again. As this alternate embodiment indicates, a number of intermediate chutes may be added to the coin mechanism 20.

Referring now to FIGS. 9, 10, 11 and 12 there are shown various views of an alternate embodiment of the present invention illustrating the use of a swinging gate 222 located between the first and second chutes 24 and 26 and the front enclosure 34 of the coin mechanism 20. The gate 222 is operable to selectively direct coins (which have been deposited in the outer coin slot 160) into either the first of the second chutes 22 and 24.

The gate 222 is suspended between the first and second chute 22 and 24 and the front 34 by an outer hanger 224 located adjacent the side plate 36 near the pawl assembly 30, and by an inner hanger 226 located adjacent the front 34. The hangers 224 and 226 are both pivotally connected to the gate 222 at their lower ends. All the connections of the hangers 224 and 226 are configured to allow motion of the gate 222 in a generally horizontal direction parallel to the front wall 34 of the coin mechanism 20.

Figure 9:
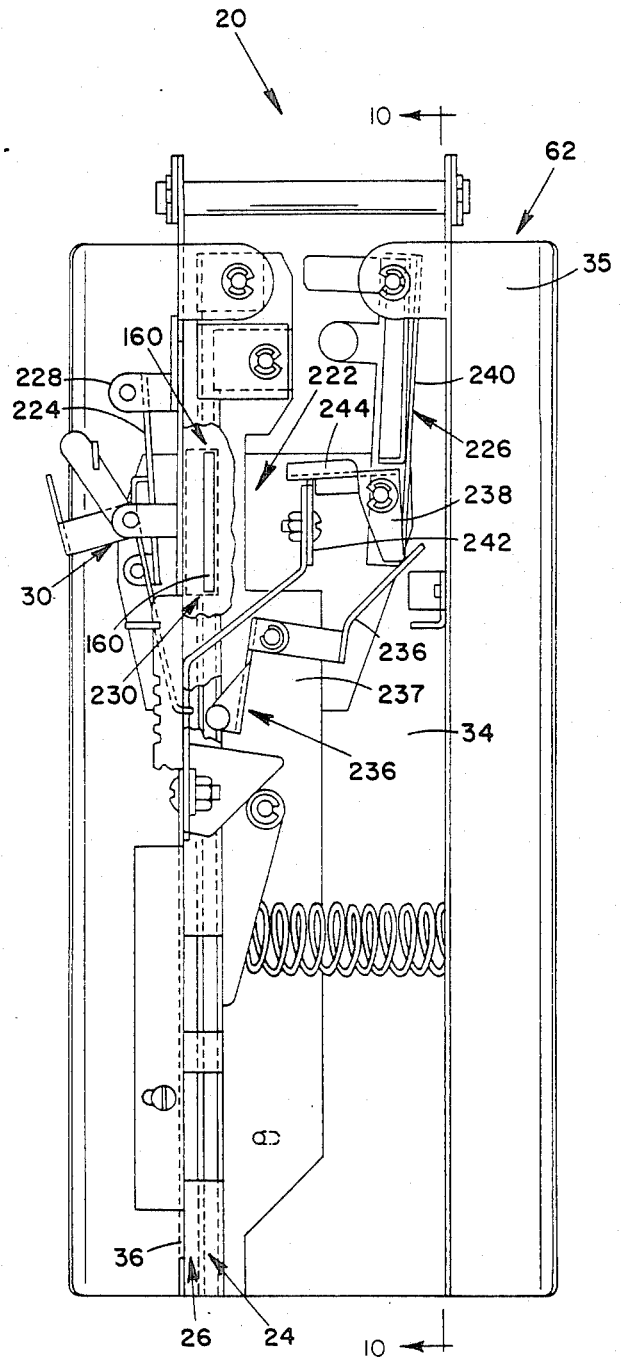
FIG. 9 is a rear elevational view of an alternate embodiment of the coin mechanism illustrating a modified gate and rocker arm assembly.

The inner hanger 226 is pivotally connected at its top to the front wall 34 and the outer hanger 224 is connected at its top to an outer hanger support 228. And, as best seen in FIG. 9, the outer hanger 224 is attached at its lower end on the far left-hand side of the gate 222 while the inner hanger 226 is attached to the upper right-hand corner of the gate 222.

Figure 12:
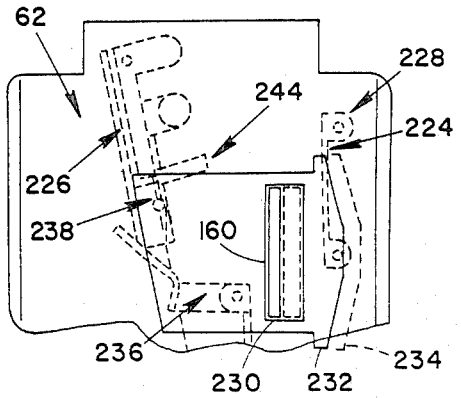
FIG. 12 is a somewhat diagrammatical detailed view of the modified gate used in the coin mechanism shown in FIGS. 9, 10 and 11.
Figure 11:
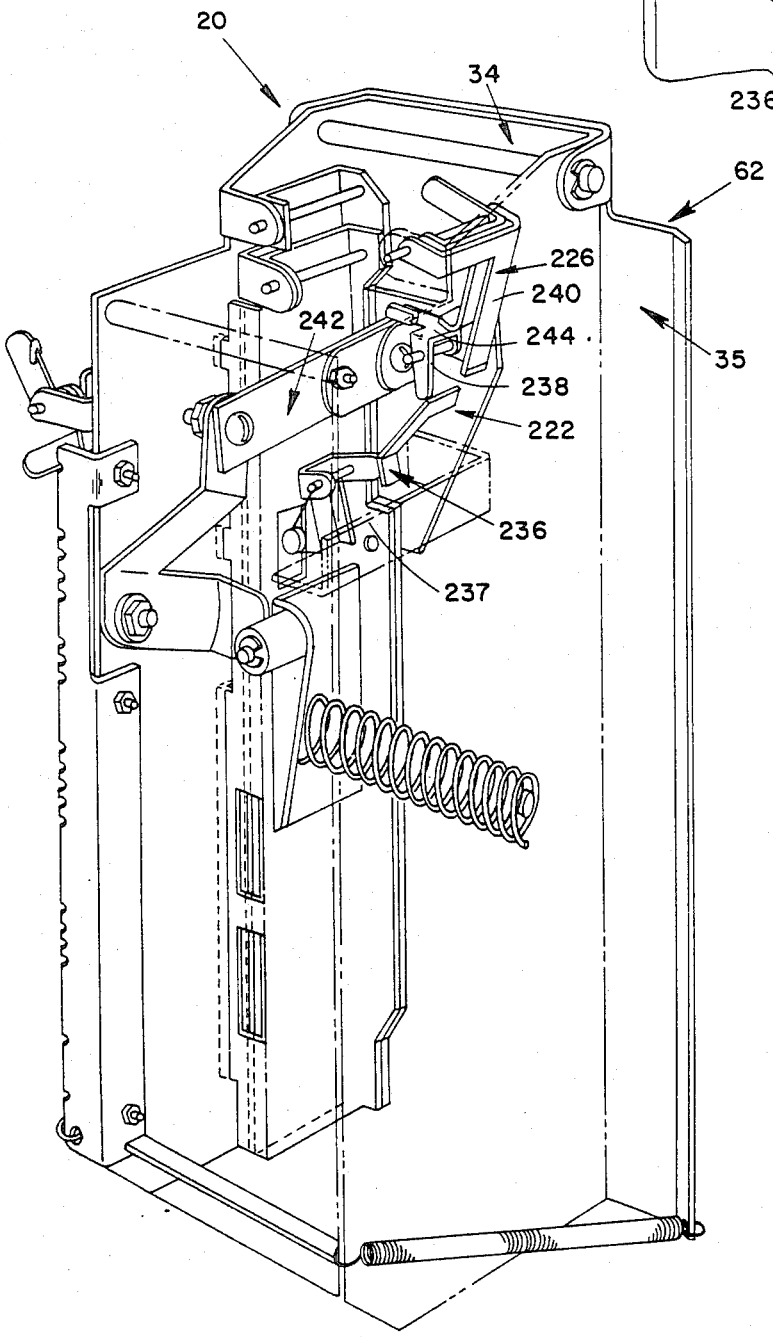
FIG. 11 is a perspective view of the coin mechanism shown in FIG. 9.

A coin slot 230 located in the gate 222 provides an opening through which coins are deposited into the coin chutes 24 and 26. Referring specifically to FIG. 12, in its first position 232 the gate is located so that the coin slot 230 directs coins from the outer coin slot 160 into the first chute 24. In its second position 234 the gate is located so that the coin slot 230 directs coins from the outer coin slot 160 into the second chute 26.

In operation, the gate 222 is moved from a first position 232 to a second position 234 as coins pass downward in the first chute 24 and engage the lower end of a linkage arm 236. The arm 236 is pivotally attached adjacent the first chute 24 to a linkage arm support 237 which extends from the first chute 24. When the coin engages the lower end of the arm 236, the arm 236 pivots about the support 237 and engages an adjustment linkage 238 which is located adjacent the top of the arm 236. The adjustment linkage 238 is pivotally attached to the gate 222 at the location where the inner hanger 226 is attached and by virtue of engagement of the arm 236 the adjustment linkage 238 is pivoted about its attachment to the gate 222. The rotation of the linkage 238 is very slight as the part of the linkage 238 above its attachment to the gate 222 engages a flange 240 which extends from the inner hanger 226 perpendicular to the front wall 34. Once the linkage 238 has engaged the flange 140 its rotation ceases whereby continued rotation of the linkage arm 236 imparts a force on the inner hanger 226 causing essentially horizontal movement of the gate 222 from its first position 232 to its second position 234. And when the coins in the first chute 24 reach a predetermined height so that the top coin is against the lower end of the linkage arm 236, the gate 222 will be held in its second position 234 and the remaining coins deposited in the outer coin slot 160 will pass through the coin slot 230 in the gate and into the second chute 26.

Figure 10:
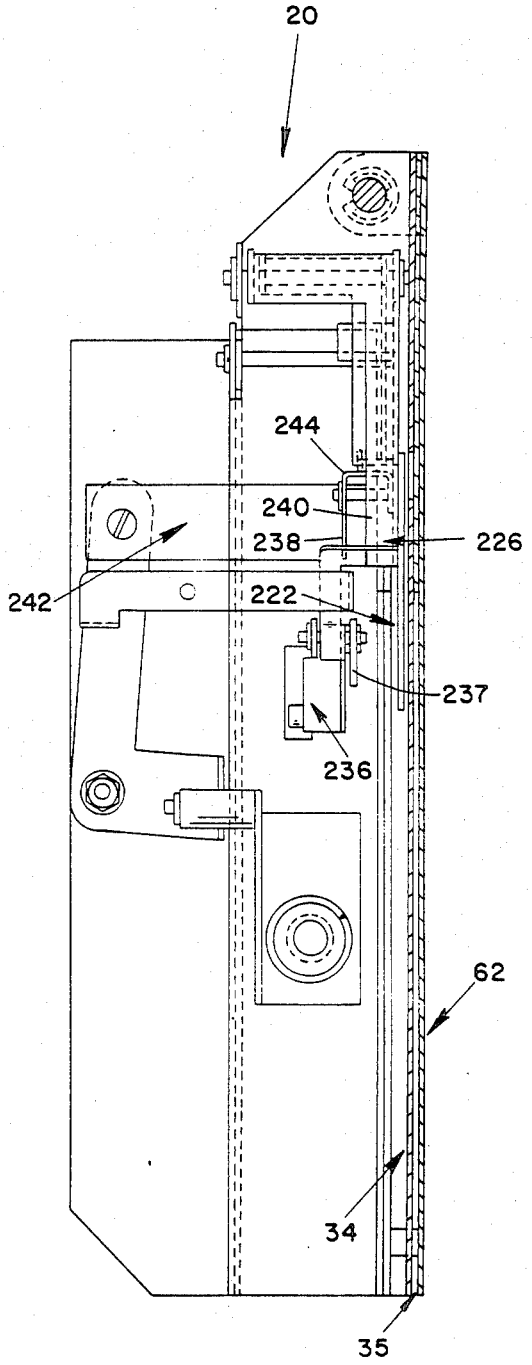
FIG. 10 is a side view of the coin mechanism shown in FIG. 9.

An adjustment bar 242 is attached to the front wall 34 and serves to maintain the gate 222 in its first position 232 during periods where no coin has engaged the lower end of the linkage arm 236. The position of the gate 222 is maintained in this manner by cooperation of the bar 242, the adjustment linkage 238 and the top of the linkage 236. As can be seen in FIGS. 9 and 10, when the gate 222 is in its first position 232, the part of the adjustment linkage 238 below its attachment to the gate 222 rests against the top of the linkage arm 236. And a lateral extension 244 of the adjustment linkage rests with its lower surface in contact with the upper surface of the bar 242. Thus, the gate 222 remains in its first position 234.

As the above description of this alternate embodiment suggests, the movement of the gate 222 approximates a horizontal sliding motion. In fact, the upward or downward movement of the gate 222 is so slight that for all practical purposes, the gate 222 is sliding from its first position 232 to its second position 234. Therefore, it is understood that substituting a track or other suitable supporting means for the hangers 224 and 226 will produce the same effect as the structure specified in this embodiment.

Referring now to FIGS. 13 through 15*a*, another important aspect of the present invention is illustrated and involves the use of the adjustment linkage 238 as a preferred means for holding the gate 222 in its first position 232 to circumvent attempts to cheat the mechanism 10 (see FIG. 12 for first and second positions 232 and 234, respectively, of the gate 222). The need for a device to retain the gate 222 in this position is appreciated when it is realized that without it, a coin or other device could be used from outside the outer coin slot 160 to push the gate 222 over to its second position 234. If the gate 222 could be manipulated in this way, a product might be obtained for only a fraction of the original intended price. For example, if the price required four quarters in the first chute 24 and one in the second chute 26, the product might be obtained with only one quarter. This is because it is the presence of the coin in the second chute 26 and its abutment with the finger 138 of the pawl 30 that makes retrieval of a product possible. Accordingly, use of the linkage 238 insures that the first chute 24 will be filled before any coins will be diverted to the second chute 26 by the gate 222.

The linkage 238 is biased by weighting one of its ends to rotate into abutment with the adjustment bar 242. And it should be noted that the inner hanger 226 and the outer hanger 224 are configured and attached to the gate 222 in such a manner as to induce movement of the gate 222 from the second gate position 234 to the first position 232. This produces a tendancy on the part of the gate 222 to return to the first position 232 nearer to the equilibrium hanging position of the gate 222, which is approximated by the configuration shown in FIGS. 13 through 15. This feature is important when it is considered relative to the cooperation of the linkage 238 and the bar 242. When the linkage 238 is resting on the bar 242, a depending flanged portion 250 is adjacent the side of the bar 242. The flanged portion 250 serves as a means for engaging the bar 242 when the gate 222 is moved toward its second position 234. This will stop movement of the gate 222 and retain the gate 222 in its first position 232 unless the linkage 238 is made to pivot so that the flanged portion 250 escapes the bar 242. This is accomplished by arranging the adjustment linkage 238 relative to the linkage arm 236 so that it will be engaged by the arm 236 and pivoted by an incremental amount 252 (see FIG. 13) before an upper end 254 of the arm 236 engages the inner hanger 226. When the linkage 238 pivots through this increment, the flanged portion 250 and lateral extension 244 are rotated out of abutment with the bar 242. The linkage 238 in this position will not engage the bar 242 so as to interfere with movement of the gate 222 to its second position 234. The upper end 254 of the arm 236 then moves into contact with the inner hanger 226 causing movement of the gate 222 to its second position 234.

Another aspect of the present invention is shown in FIGS. 13 through 15*a* and involves the use of a tilt responsive mechanism for preventing movement of the gate 222 to its second position 234 when the mechanism 20 is tilted to the left (as viewed in FIG. 13). The tilt responsive mechanism is perferably provided by a bumper 256 pivotally connected to the front wall 34 at its top adjacent the connection of the inner hanger 226 to the wall 34. The bumper 256 is dimensioned so that when the mechanism 20 is tilted in the fashion described, it will rest with its lower end above a contact flange 258 which extends up from the adjustment linkage 238. The bumper 256 is prevented from rotating past the flange 258 by a cylindrical stop 260 which is formed as an extension of the inner hanger 226. When the bumper 256 rotates in the direction of the flange 258, a leading edge 262 of the bumper 256 engages the stop 260 at a point where the lower end of the bumper 256 is immediately above the flange 258. In this position, the lower end of the bumper 258 effectively prevents the linkage 238 from pivoting to allow the other flanged portion 250 of the linkage 238 to escape the adjustment bar 242. Thus, the gate 222 cannot be moved to its second position 234 when the mechanism 20 is tilted on its side, insuring that only the required number of coins will serve to operate the mechanism 20 even when it is tilted.

Referring now to FIGS. 16 and 17 in conjunction with FIGS. 13 through 15*a* and 15*b*, there is shown a preferred means for urging and translating the arm 236 in the direction of the linkage 238 independently of the presence or absence of coins within the first chute 24 so that the arm 236 will engage the linkage 238 and the upper part 254 of the arm 236 will engage the inner hanger 226 to move the gate 222 from its first position 232 to its second position 234. This result is accomplished by a series of linkages and levers to be described below, which are configured and arranged to be selectively operable from outside the mechanism 20. As best seen in FIGS. 13 and 15*a*, a lever 264 is rockably mounted to engage, on the upper surface of its inner end 266, a lower edge of the arm 236. Action of the lever 264 against the arm 236 produces essentially the same effect on the arm 236, the linkage 238, and the gate 222 as would the presence of a coin in the first chute 24 against a lower finger portion 268 of the arm 236 which enters the first chute 24. This results in the gate 222 being held in its second position 234 to direct coins only into the second chute 26.

A preferred means for imparting a force to rock the lever 264 in the direction of the arm 236 is provided by a spring and lever arrangement which includes an outer horizontal lever 270 having a forward end 272 connected as by a spring 274 to the outer end 275 of the lever 264. The outer lever 270 is pivotally connected to a side plate 276 to rock through a vertical arc. A rearward end 278 of the lever 270 is connected to the side plate 276 by a spring 280. In the configuration shown in FIGS. 15*a* and 15*b*, the outer end 275 of the lever 264 exits the side plate 276 through an opening 282, the spring 274 depending down from the outer end 275 to connect with the outer horizontal lever 270. The downward force of the spring 280 on the rearward end 270 of the lever 278 causes the forward end 272 to push up against the spring 274 to hold the lever 264 against the top edge of the opening 282.

The outer lever 270 is pivotally connected by a linkage 284 to a U-shaped lever 286 which is shown near the top of the mechanism 20. The end of the U-shaped lever 286 opposite its connection to the linkage 284 is configured with a generally vertical slot 288. A push-pull rod (not shown) extends from the slot 288 to a suitable key operated device (also not shown) on the front of the mechanism 20 and is operable to cause the lever 286 to move up and down at its ends about its pivotal connection 290 near the top of the mechanism 20 in response to the key operated device. Downward movement of the end of the lever 286 at the slot 288 causes a corresponding downward movement of the end of the lever 286 at its connection to the linkage 284. The linkage 284 forces the forward end 272 of the outer lever 270 down which, by virtue of the spring 274, pulls the outer end 275 of the lever 264 down. The inner end 266 of the lever 264 moves up as the lever 264 fulcrums on its connection causing the lever 264 to move into contact with the arm 236 to move the gate 222 to its second position 234.

The spring 280 biases the outer lever 270 to return to its generally horizontal position as shown in FIGS. 15*a* and 15*b* so that when the U-shaped lever 286 is pivoted downward at the slot 288, there also exists a force encouraging the lever 286 to return to its generally horizontal orientation. And the lever 264 is configured with a weight on its inner end 266 to bias rotation of the lever 264 away from the arm 236. Thus, after the U-shaped lever 286 is returned to its horizontal position, the lever 264 does not interfere with the function of the arm 236 when the finger 268 is engaged by a coin within the first chute 24.

Referring now to FIGS. 16 and 17, there are shown additional pawls 30 adjacent the side plate 36. The finger 138 of each pawl 30 is accessible to the inside of the second chute 26 by means of a vertical slot 292 extending generally along the length of the second chute 26. A tab 294 extending out from the side of the pawl arm 130 at its lower end engages a forward vertical edge 296 of the slot 292 when the finger 138 is made to enter the second chute 26 as shown in FIG. 17.

The pawls 30 can be positioned along the notched rim 122 in any desired location and selectively locked out by use of adjustably mounted dogs 298 shown in FIG. 16 which are located on a dog support bar 300 pivotally connected to the U-shaped lever 286 at its top. The support bar 300 is slidably supported at its lower end by a dog bar support 302 so that the bar 300 is free to move up and down as the lever 286 pivots on its connection 290. A pawl 30 can be locked-out so that the finger 138 does not enter the second chute 26 if a dog 298 is positioned against an inner face 304 of a bent over portion 306 shown extending forwardly from the back of each pawl 30 (see middle pawl 30 in FIG. 16).

It should be noted that the pawls 30 are weight biased by the bent over portions 306 to encourage rotation of the arms 138 into the second chute 26. It is therefore necessary to hold the pawls 30 in a position so that the fingers 138 are outside of the second chute 26 when the gate 222 is in its first position 232 as it is in FIG. 16. Otherwise, the presence of a coin in the second chute 26 could result in the mechanism 20 being operable to allow opening of the contents portion and retrieval of a product when insufficient coinage had been deposited.

A preferred means for holding the pawls 30 so that the fingers 138 are out of the second chute 26 is provided by a vertical positioning bar 308 extending from the gate 222. A holding arm 310 extends up from each pawl 30 and engages the positioning bar 308 on a bent over flanged portion 312 of the bar 308 which extends toward the back of the mechanism 20. The arms 310 are generally in continuous contact with the bar 308 which is spaced from the coin slot 230 in the gate 222 so that when the gate 222 is in its first position 232, the pawl fingers 138 are held out of the second chute 26. When the gate 222 is moved to its second position 234 as shown in FIG. 17, the bar 308 moves likewise to allow the pawls 30 to rotate in the direction of the second chute 26 so that the fingers 138 enter the chute 26 through the slot 292. The pawls 30 are still free in this configuration to move when the fingers 138 are engaged by a coin passing through the second chute 26. But when the gate 222 is in the first position 232, the positioning bar 308 holds the pawls 30 away from the second chute 26 so that a coin within the chute 26 will not engage the fingers 138 of the pawls 30. In this configuration, the pawls 30 do not prevent coins from moving up the second chute 26 when an attempt is made to move the catch plate 32 from beneath the chutes 24 and 26. As a result, the catch plate 32 is not forced down so it does not escape the hook 100, and the door 33 will not open (see FIG. 1).

A nickel ejection opening 320 is shown in FIG. 18 formed in the width wall 147 which separates the first and second chutes 24 and 26. The opening 320 is large enough to allow passage of a nickle out of the first chute 24 into the second chute 26, but will generally prevent quarters from doing so. It is seen that the opening 320 is formed generally across from the second opening 89 in the width wall 72 of the first chute 24. This location insures that the finger 268 (partially shown in FIG. 18 entering the second opening 89) will engage a nickle falling through the first chute 24 adjacent the opening 320 and eject it through the opening 320. To facilitate nickle ejection, the finger 268 is configured with two generally parallel curved portions 322 spaced apart so that the finger 268 engages the face of a coin without imparting a twisting force on the coin which may cause it to jam in the chute 24. This twisting might occur, e.g., if the finger 268 had a single point of contact with the coin and the coin was a nickle that happened to be slightly off from the center of the first chute 24. The nickle might be ejected into the opening 320 in a twisted position and, thus, jam the first and second chutes 24 and 26. Moreover, the smooth, downwardly sloping upper surfaces of the curved portions 322 aid in eliminating jamming of both quarters and nickles as well as providing for easy ejection of nickles into the second chute 26.

It should be appreciated that nickles, having a smaller diameter than quarters, will stack up to a different height in the second chute 26 than would the same number of quarters. In fact, even the presence of one nickle in the second chute 26 will cause the height of any additional quarters deposited into the second chute 26 to be at variance with the predetermined position of the finger 138 of a pawl 30. This will prevent the mechanism 10 from being operable to allow retrieval of a product because the top coin in the second chute 26 will not be positioned directly under the finger 138 of the pawl. Coins in the second chute 26 will be free to move up the chute 26 and, therefore, the cam 102 will not be pushed down by the coins so as to release the catch plate 32. In the event this occurs, the coins must be retrieved by use of the coin return mechanism (not shown). It should also be noted that the horizontal dimension of the opening 320, while sufficient to allow passage through of a nickle as shown in FIG. 18, is not sufficient to allow a quarter to move through. So a quarter falling through the first chute 24 will engage the curved portions 322 and be deflected somewhat against the surface of the width wall 147 facing the opening 89, but will continue to fall down the first chute 24 and will not be ejected out the opening 320. At the same time, the quarter will cause movement of the finger 268 out of the opening 89 and consequent movement of the linkage arm 236 moving the gate 222 from its first position 232 to its second position 234. Engagement by the falling nickle, however, while causing some small movement of the linkage arm 236, does not cause complete movement of the gate 222 to its second position 234. This is because the nickel never completely occupies the space of first chute 24 adjacent the opening 89 so as to move the finger 268 completely out of the first chute 24, but is deflected out of the chute 24 through the ejector opening 320. To ensure that the nickle is ejected in the manner described above, it may be necessary to align the coin as it is falling through the first chute 24 after it is deposited into the chute 24. This is preferably accomplished by a bumper pawl 340, best seen in FIGS. 14 and 15*a* pivotally mounted toward the upper end of the width wall 72 of the first chute 24, and biased such as by a cylindrical weight 342 to encourage rotation of a finger portion 344 of the bumper pawl 340 into the first chute 24. As can be seen, the finger 344 enters the chute 24 through an opening 346 in the upper part of the edge wall 76. The opening 346 is located slightly above the entrance of the finger 268 of the linkage arm 236 into the first chute 24 so that the finger 344 of the bumper pawl 340 will be engaged by a coin passing down the first chute 24 before the coin engages the curved portions 322 of the finger 268 of the linkage arm 236. And it is seen that the finger 344 will be engaged by the edge of the coin to cause a slight deflection of the coin toward the center of the chute 24 if the coin is close enough to the inner face of the edge wall 76 to engage the part of the finger 344 protruding into the first chute 24. This deflection is sufficient to insure that the curved portions 322 will be engaged by the nickle in about the center of the face of the nickle instead of near one of the edges which might be the case if the nickle were allowed to travel by the curved portions 322 with an edge of the nickle near the edge wall 76. Thus, jamming of the coins in the chute 24 or in the ejector opening 320 is minimized. The bumper pawl 340 is also effective in the same way as regards dimes or pennies which may also be deposited into the first chute 24 if it is desired that they too be ejected through the opening 320. Finally, it should be noted that the structure and function described above is equally useful in coin mechanisms which would operate in response to dimes, nickles or other currencies where it is desired to selectively eject certain types of coins from the first chute 24, with the ejector opening 320 and first chute 24 being dimensioned as required by relevant design considerations.

Although particular embodiments of the invention have been described in the foregoing detailed description, it will be understood that the invention is capable of numerous rearrangements, modifications, and substitutions of parts without departing from the scope of the invention as set forth in the claims below.

What is claimed is:

1. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing the coins into one of said chutes, said gate being operable in said first gate position to direct coins into said first chute and being operable in said second gate position to direct coins into said second chute;

means for engaging and applying a force to move said gate at least from the first gate position to the second gate position in response to the presence of a coin in said first chute; and a disengageable gate retainer for holding said gate in said first position, said gate retainer being responsive to said means for engaging to be disengaged by said means for engaging and allow said means for engaging to engage and apply a force to move said gate at least from said first gate position to said second gate position.

2. The coin mechanism of claim 1, wherein said gate moves essentially horizontally when engaged by said means for engaging, said gate having a coin slot formed in its side to pass coins into said first chute in said first gate position and to pass coins into said second chute in said second gate position.

3. The coin mechanism of claim 1, further comprising means for preventing said gate retainer from being disengaged by said means for engaging when the mechanism is rotated in a plane generally parallel to the movement of said gate from the first gate position to the second gate position.

4. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing coins into one of said chutes, said gate being operable in said first gate position to direct coins into said first chute and being operable in said second gate position to direct coins into said second chute;

means for moving said gate at least from the first gate position to the second gate position in response to the presence of a coin in said first chute;

a disengageable gate retainer for holding said gate in said first position, said disengageable gate retainer being pivotally connected to said gate and configured to be pivoted by an incremental amount by said means for moving;

a stop for holding said gate retainer to prevent movement of said gate to the second position, said retainer being biased to pivot in the direction of said stop; and said gate retainer being configured so that when said means for moving engages said retainer, said retainer is pivoted by said incremental amount and clears said stop, whereby engagement of said gate by said means for moving causes said gate to move at least from said first gate position to said second gate position.

5. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing coins into one of said chutes, said gate being operable in said first gate position to direct coins into said first chute and being operable in said second gate position to direct coins into said second chute;

means for moving said gate at least from the first gate position to the second gate position in response to the presence of a coin in said first chute, said means for moving comprising:

a mechanical linkage pivotally mounted adjacent said first chute for movement between at least a first and a second linkage position;

contact means formed on said mechanical linkage for engaging and moving said gate at least from the first gate position to the second gate position when said mechanical linkage moves from the first linkage position to the second linkage position; and finger means formed on said mechanical linkage for engaging coins in said first chute and being operable to move said mechanical linkage at least from the first linkage position to the second linkage position when engaged by a coin in said first chute so that a coin in said first chute will engage said finger means causing said finger means to move said mechanical linkage to the second linkage position, and cause said contact means to move said gate from the first gate position to the second gate position; and a disengageable gate retainer for holding said gate in said first position, said gate retainer being responsive to said means for moving to disengage and to allow said gate to move at least from said first gate position to said second gate position.

6. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing coins into one of said chutes, said gate being operable in said first gate position to direct coins into said first chute and being operable in said gate position to direct the coins into said second chute;

means for moving said gate at least from the first gate position to the second gate position in response to the presence of the coin in said first chute;

a disengageable gate retainer for holding said gate in said first position, said gate retainer being responsive to said means for moving to disengage and allow said gate to move at least from said first gate position to said second gate position; and said means for moving comprising a rocker arm pivotally connected adjacent said first chute, said rocker arm having one end engageable by coins within said first chute and having another end operable to disengage said gate retainer and move said gate in response to the presence of a coin in said first chute.

7. A coin mechanism for use in a dispensing machine to receive and detect the presence of a predetermined number of coins comprising:

at least first and second generally vertical coin chutes for receiving coins of a predetermined dimension and having the width and thickness of about, but greater than, the width and thickness of the coins;

a gate mounted in the mechanism movable between at least first and second gate positions for selectively directing coins into one of said chutes, said gate being operable in said first gate position to direct coins into said first chute and being operable in said second gate position to direct coins into said chute;

means for moving said gate at least from the first gate position to the second gate position in response to the presence of a coin in said first chute;

a disengageable gate retainer for holding said gate in said first position, said gate retainer being responsive to said means for moving to disengage and allow said gate to move at least from said first gate position to said second gate position; and means for preventing said gate from moving from said first gate position to said second gate position when the mechanism is rotated in a plane generally parallel to the movement of said gate from the first gate position to the second gate position and said means for preventing comprising:

a contact formed on said gate retainer; and a bumper pivotally mounted adjacent said gate retainer, said bumper operable to pivot when the mechanism is rotated to engage said contact to prevent said gate retainer from being disengaged.

8. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing coins into one of said chutes, said gate being operable in said first gate position to direct coins into said first and being operable in said second gate position to direct the coins into said second chute;

means for moving said gate at least from the first gate position to the second gate position in response to the presence of a coin in said first chute;

a disengageable gate retainer for holding said gate in said first position, said gate retainer being responsive to said means for moving to disengage and allow said gate to move at least from said first gate position to said second gate position; and means for urging and translating said means for moving in the direction of said gate retainer independently of the presence or absence of coins within said first chute so that said means for moving disengages said gate retainer and moves said gate at least from said first gate position to said second gate position.

9. The coin mechanism of claim 8, wherein said means for urging and translating is configured and arranged to be selectively operable from outside the mechanism.

10. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing coins into one of said chutes, said gate being operable in said first gate position to direct coins into said first chute and being operable in said second gate position to direct coins into said second gate chute;

means for moving said gate at least from said first gate position to said second gate position in response to the presence of a coin in said first chute; and a tilt responsive mechanism movably mounted in the mechanism and configured to move and engage said means for moving and prevent said means for moving from moving said gate from said first gate position to said second gate position when the coin mechanism is rotated in a plane generally parallel to the direction and movement of said gate from said first gate position to said second gate position.

11. The coin mechanism of claim 10, further comprising a gate retainer for holding said gate in said first gate position, said gate retainer being disengageable in response to said means for moving to allow movement of said gate from said first gate position to said second gate position.

12. The coin mechanism of claim 11, wherein said tilt responsive mechanism comprises:

a contact connected to said gate;

a bumper pivotally mounted adjacent said contact, said bumper operable to pivot when the mechanism is rotated to engage said bumper to prevent said gate from moving from said first gate position to said second gate position.

13. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coin;

a gate mounted in the mechanism movable between at least first and second gate positions for selectively directing coins into one of said chutes, said gate being operable in said first gate position to direct coins into said first chute and being operable in said second gate position to direct coins into said second chute;

means for moving said gate at least from said first gate position to said second gate position in response to the presence of a coin in said first chute;

a tilt responsive mechanism for preventing said gate from moving from said gate position to said second gate position when the coin mechanism is rotated in a plane generally parallel to the direction of movement of said gate from said first gate position to said second gate position;

a gate retainer for holding said gate in said first gate position, said gate retainer being disengageable in response to said means for moving to allow movement of said gate from said first gate position to said second gate position;

said gate retainer being pivotally connected to said gate and configured to be pivoted by an incremental amount by said means for moving before said means for moving engages said gate;

a stop for engaging said gate retainer, said gate retainer being biased to pivot in the direction of said stop and having a lip formed thereon for engaging said stop to prevent movement of said gate from said first to said second position; and said gate retainer being configured so that when said gate retainer is pivoted by said incremental, said lip escapes said stop permitting said means from moving to engage said gate to move said gate from said first gate position to said second gate position.

14. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing coins into one of said chutes, said gate being operable in said first gate position to direct coins into said first chute and being operable in said second gate position to direct coins into said second chute;

means for moving said gate at least from said first gate position to said second gate position in response to the presence of a coin in said first chute;

a tilt responsive mechanism for preventing said gate from moving from said first gate position to said second gate position when the coin mechanism is rotated in a plane generally parallel to the direction of movement of the said gate from said first gate position to said second gate position;

a gate retainer for holding said gate in said first gate position, said gate retainer being disengageable in response to said means for moving to allow movement of said gate from said first gate position to said second gate position; and means for urging and translating said means for moving in the direction of said gate retainer independently of the presence or absence of coins within said chute so that said means for moving disengages said gate retainer and moves said gate from said first gate position to said second gate position.

15. A coin mechanism for use in a dispensing machine to receive and detect the presence of a predetermined number of coins, comprising:

at least first and second generally vertical coin chutes for receiving coins of a predetermined dimension and having a width and thickness of about, but greater than, the width and thickness of the coins;

a gate mounted in the mechanism movable between at least first and second gate positions for selectively directing coins into one of said chutes, said gate being operable in said first gate position to direct coins into said first chute and being operable in said second gate position to direct coins into said second chute;

means for moving said gate at least from the first gate position to the second gate position in response to the presence of a coin in said first chute;

pawl means operable to allow coins to move down said second chute and prevent coins from moving up said second chute; and positioning means responsive to movement of said gate operable to position said pawl means, said positioning means being in contact with said pawl means when said gate is in its first position to hold said pawl means away from said second chute so that coins within said second chute will not engage said pawl means when said gate is in its first position.

16. The coin mechanism of claim 15, further comprising a gate retainer for holding said gate in said first position, said gate retainer being operable to be disengaged by said means for moving to allow said means for moving to move said gate from said first gate position to said second gate position.

17. The coin mechanism of claim 15, further comprising means for preventing said gate from moving from said first gate position to said second gate position when the mechanism is rotated in a plane generally parallel to the direction of movement of said gate from said first to said second gate position.

18. The coin mechanism of claim 16, further comprising means for urging and translating said means for moving in the direction of said gate retainer independently of the presence or absence of coins within said first chute so that said means for moving disengages said gate retainer permitting said means for moving to move said gate from said first gate position to said second gate position.

19. The coin mechanism of claim 18, wherein said means for urging and translating comprises:

a lever rockably mounted in the mechanism and biased to rock away from said means for moving; and means for imparting a force to rock said lever in the direction of said means for moving to cause said means for moving to disengage said gate retainer and cause said means for moving to move said gate from said first gate position to said second gate position.

20. The coin mechanism of claim 18, wherein said means for imparting a force is configured and arranged to be selectively operable from outside the mechanism.

21. The coin mechanism of claim 18, further comprising:

a dog support bar connected to said means for urging and translating; and at least one dog adjustably mounted on said dog support bar for holding at least one of said pawls away from said second chute so that at least one pawl will not engage coins within said second chute when said gate is in said second gate position.

* * * * *

UNITED STATES PATENT AND TRADEMARK OFFICE

CERTIFICATE OF CORRECTION

PATENT NO. : 4,693,357

DATED : September 15, 1987

INVENTOR(S) : Weldon J. Aschenbeck, et al.

It is certified that error appears in the above-identified patent and that said Letters Patent is hereby corrected as shown below:

Column 8, line 4, "insted" should be --instead--.

Column 9, line 44, "cin" should be --coin--.

Column 11, line 62, "is" should be --as--.

Column 14, line 54, "140" should be --240--.

Column 15, line 3, insert --arm-- after "linkage".

Column 24, line 2, insert --first-- after "said". (1st occurrence)

Signed and Sealed this

Ninth Day of February, 1988

*Attest:*

DONALD J. QUIGG

*Attesting Officer*

*Commissioner of Patents and Trademarks*